US005565297A

United States Patent [19]

Larson et al.

[11] Patent Number: 5,565,297

[45] **Date of Patent: * Oct. 15, 1996**

[54] LIQUID DEVELOPER COMPOSITIONS WITH OXYGEN CONTAINING COPOLYMERS

[75] Inventors: James R. Larson, Fairport; John W. Spiewak, Webster, both of N.Y.

[73] Assignee: Xerox Corporation, Stamford, Conn.

[ * ] Notice: The term of this patent shall not extend beyond the expiration date of Pat. No. 5,407,775.

[21] Appl. No.: 297,080

[22] Filed: Aug. 29, 1994

[51] Int. Cl.[6] ..... G03G 9/135; G03G 9/13

[52] U.S. Cl. ..... 430/115; 430/114; 430/119; 430/904

[58] Field of Search ..... 430/115, 112, 430/114, 904, 119

[56] References Cited

U.S. PATENT DOCUMENTS

| | | | |
|---|---|---|---|
| 4,707,429 | 11/1987 | Trout | 430/115 |
| 5,019,477 | 5/1991 | Felder | 430/115 |
| 5,035,972 | 7/1991 | El-Sayed et al. | 430/114 |
| 5,223,368 | 6/1993 | Ciccarelli et al. | 430/110 |
| 5,306,591 | 4/1994 | Larson et al. | 430/115 |
| 5,308,731 | 5/1994 | Larson et al. | 430/115 |
| 5,407,775 | 4/1995 | Larson et al. | 430/115 |

OTHER PUBLICATIONS

Grant & Hackh's Chemical Dictionary, 5th Edition, Ed. R. Grant and C. Grant, McGraw Hill Book Company, NY, (1987) p. 24.

*Primary Examiner*—Janis L. Dote
*Attorney, Agent, or Firm*—E. O. Palazzo

[57] ABSTRACT

A liquid developer comprised of a liquid, thermoplastic resin particles, a nonpolar liquid soluble charge director comprised of at least one oxygen containing group with from 1 to 5 oxygen atoms covalently bound to a quaternized ammonium nitrogen in an AB diblock copolymer or an ABA triblock copolymer wherein the A block is polar and is an ammonium containing polymer, and the B block is nonpolar and is a nonpolar fluid soluble polymer, and wherein the A blocks possess a number average molecular weight range of from about 200 to about 10,000 and the B blocks possess a number average molecular weight range of from about 2,000 to 50,000 and the ratio of weight average molecular weight $M_w$ to number average molecular weight $M_n$ is 1 to 5.

20 Claims, No Drawings

LIQUID DEVELOPER COMPOSITIONS WITH OXYGEN CONTAINING COPOLYMERS

BACKGROUND OF THE INVENTION

This invention is generally directed to liquid developer compositions and, more specifically, to liquid developers containing block copolymer negative charge directors comprised of a polar A block and a nonpolar B block wherein the polar A block contains an ammonium group which has at least one oxygen containing ligand covalently bounded to the ammonium nitrogen. In embodiments, the charge directors of the present invention are comprised of diblock copolymers of the formula A-B, or triblock copolymers of the formula A-B-A, having a ratio of weight average molecular weight $M_w$ to number average molecular weight $M_n$ of 1 to 5, wherein at least one ligand covalently bound to the ammonium nitrogen in the polar A block contains at least one oxygen bearing group, such as an ether, a carboxylic acid, a carboxylic acid ester, or an alcohol, and the nonpolar B block is a nonpolar fluid soluble polymer, and wherein, the A block has a number average molecular weight range of from about 200 to about 10,000 and the B block has a number average molecular weight range of from about 2,000 to about 50,000. It is believed that the oxygen atoms increase the ion complexing character of the interior of the inverse micelle, probably through hydrogen bonding, and thereby enhance negative particle charging compared to the same negative charge director copolymers bearing only aliphatic ligands on the ammonium nitrogen. The developers of the present invention can be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent change in fluid viscosity caused, for instance, by a 5° C. to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor solid area coverage if insufficient toner is transferred to the final substrate and can also lead to image defects such as smears and hollowed fine features. To overcome or minimize such problems, the liquid toners of the present invention were arrived at after substantial research efforts, and which toners result in, for example, sufficient particle charge for transfer and maintain the mobility within the desired range of the particular imaging system employed. Examples of specific advantages associated with the present invention include increasing the desired negative charge on the developer particles and in embodiments providing a charge director, that is superior since, for example, it provides in embodiments a higher charging rate and a higher charging level as compared to AB tetraalkyl quaternary ammonium block copolymers, lecithin, and metal salts of petroleum fractions. Some of the aforementioned additives like lecithin contain impurities which can have an adverse effect on their intended function. The superior charge can result in improved image development and superior image transfer. The oxygen containing ligands in these charge directors are believed to allow for the more efficient micelle formation which allows for higher particle charging.

With respect to the charge directors of the present invention, at least one oxygen containing ligand includes from 1 to 5 oxygen atoms bound to a quaternized ammonium nitrogen.

A latent electrostatic image can be developed with toner particles dispersed in an insulating nonpolar liquid. The aforementioned dispersed materials are known as liquid toners or liquid developers. A latent electrostatic image may be generated by providing a photoconductive layer with a uniform electrostatic charge, and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Typical liquid developers can comprise pigment, a thermoplastic resin and a dispersant nonpolar liquid. Generally, a suitable colorant, such as a dye or pigment, is normally present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 microns (μm) average by area size as measured using the Horiba Capa 500 or 700 particle sizer.

Since the formation of images depends, for example, on the difference in the charge between the toner particles in the liquid developer and the latent electrostatic image to be developed, it is desirable to add a charge director compound and charge adjuvants which increase the magnitude of the charge, such as polyhydroxy compounds, amino alcohols, polybutylene succinimide compounds, aromatic hydrocarbons, metallic soaps, and the like, to the liquid developer comprising the thermoplastic resin, the nonpolar liquid and the colorant.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors disclosed may include both negative charge directors, such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene, and (iv) selected from the group consisting of butadiene and acrylate.

Moreover, in U.S. Pat. No. 4,707,429 there are illustrated, for example, liquid developers with an aluminum stearate charge additive. Liquid developers with charge directors are also illustrated in U.S. Pat. No. 5,045,425. Further, stain elimination in consecutive colored liquid toners is illustrated in U.S. Pat. No. 5,069,995. Additionally, of interest are U.S. Pat. Nos. 4,760,009; 5,034,299 and 5,028,508.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., which developer has a melting point of at least about 25° C., the contact occurring while the developer is maintained at a temperature at or above its melting point, the developer having a viscosity of no more than about 500 centipoise and a resistivity of no less than about 108 ohm-cm at the temperature maintained while the developer is in contact with the latent image; and (c) cooling the developed image to a temperature below its melting point subsequent to development.

In copending patent application U.S. Ser. No. 065,414, the disclosure of which are totally incorporated herein by reference, there is illustrated a liquid developer comprised of a certain nonpolar liquid, thermoplastic resin particles, a nonpolar liquid soluble ionic or zwitterionic charge director, and a charge adjuvant comprised of an aluminum hydroxycarboxylic acid, or mixtures thereof.

U.S. Pat. No. 5,306,591 discloses a liquid developer comprised of thermoplastic resin particles, a charge director, and a charge adjuvant comprised of an imine bisquinone; and U.S. Pat. No. 5,308,731 discloses a liquid developer comprised of a liquid, thermoplastic resin particles, a nonpolar liquid soluble charge director, and a charge adjuvant comprised of a metal hydroxycarboxylic acid.

More specifically, in the above copending patent application U.S. Ser. No. 065,414, the disclosure of which are totally incorporated herein by reference, there is illustrated a liquid developer comprised of thermoplastic resin particles, and a charge director comprised of an ammonium AB diblock copolymer of the formula

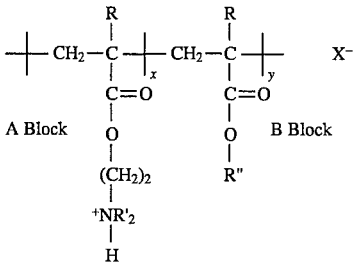

wherein X− is a conjugate base or anion of a strong acid; R is hydrogen or alkyl; R' is alkyl; R" is an alkyl group containing from about 6 to about 20 carbon atoms; and y and x represent the number average degree of 10 polymerization (DP) wherein the ratio of y to x is in the range of from about to 2 to about 100 to 20.

In U.S. Pat. No. 5,407,775, the disclosure of which is totally incorporated herein by reference, there is illustrated a liquid developer comprised of a liquid, thermoplastic resin particles, a nonpolar liquid soluble charge director comprised of a zwitterionic quaternary ammonium block copolymer wherein both cationic and anionic sites contained therein are covalently bonded within the same polar repeat unit in the quaternary ammonium block copolymer.

SUMMARY OF THE INVENTION

Examples of objects of the present invention include:

It is an object of the present invention to provide liquid developers with many of the advantages illustrated herein.

Another object of the present invention is to provide liquid developers capable of high particle charging and rapid toner charging rates.

Another object of the present invention is to provide a negatively charged liquid developer wherein there are selected certain AB diblock copolymer charge directors wherein the polar A block contains an oxygen bearing group covalently bound to the quaternary ammonium nitrogen wherein the oxygen is contained in an ether, carboxylic acid, carboxylic acid ester, or alcohol group, and the B block is a nonpolar fluid soluble polymer.

Examples of acceptable conductivity and mobility ranges for developers charged with the oxygen containing AB diblock copolymer charge directors of the present invention are illustrated herein. Conductivities, measured at ambient temperature (21° to 23° C.), for developers containing one percent toner solids where toner solids are comprised of thermoplastic resin (40 to 99.9 percent) pigment (5 to 60 percent), and charge adjuvant (0.1 to 10 percent), are considered to be acceptable in the 10 to 15 pmho/centimeter range. Also, in an acceptable conductivity range of 10 to 15 pmhos/centimeter, the liquid toner or developer of this invention possesses a mobility between about −1 to about $1.99\times10^{-10}$ $m^2/Vs$ and 9preferably from about −2.00 to about $2.49\times10^{-10}$ $m^2/Vs$, and most preferably from about −2.50 to about $5\times10^{-10}$ $m^2/Vs$. Furthermore, it is desirable that these mobility ranges occur within about 10 days and preferably within 1 day of adding the charge director to the liquid toner, and wherein the ion complexing character of the interior of the micelle enhances particle charging by the presence of oxygen atoms available for ion complexation.

It is still a further object of the invention to provide a liquid developer wherein developed image defects such as smearing, loss of resolution and loss of density are eliminated, or minimized.

Also, in another object of the present invention there are provided negatively charged liquid developers with certain oxygen containing quaternary ammonium AB diblock copolymer charge directors, which are superior in embodiments to, for example, AB diblock tetraalkyl quaternary ammonium copolymers since, for example, they result in higher negative toner particle charge. The superior charge observed after one day with, for example, a 1 percent solids cyan (PV FAST BLUE™) developer charged at 5 percent charge director solids relative to developer solids with the oxygen containing 2-bromoethyl ethyl ether quaternized AB diblock ammonium copolymer charge director, poly(2-ethylhexyl methacrylate-co-N,N-dimethyl-N-2-ethoxyethyl-N-ethyl methacrylate ammonium bromide), was $-2.47\times10^{-10}$ $m^2/Vs$ versus $-0.38\times10^{-10}$ $m^2/Vs$ for the corresponding cyan developer after two days charged at the same level with a non-oxygen containing tetraalkyl quaternized AB diblock ammonium copolymer charge director. Aging the above two liquid developers for about a month continued to result in superior charging from the developer containing the charge director which contained ether oxygen in one of the substituents on the quaternary nitrogen. Similar results were encountered when the oxygen containing substituent contained one or more hydroxyl groups or carboxylic acid groups.

Another object of the present invention resides in the provision of negatively charged liquid toners with certain oxygen containing quaternary ammonium AB diblock copolymer charge directors, and wherein in embodiments enhancement of the negative charge of NUCREL® based toners, especially cyan toners, is enhanced.

These and other objects of the present invention can be accomplished in embodiments by the provision of liquid developers with certain charge directors. In embodiments, the present invention is directed to liquid developers comprised of a toner resin, pigment, charge additive and a charge director comprised of an oxygen containing quaternary ammonium AB diblock copolymer. In embodiments, the aforementioned charge director contains one polar ammonium A block and one B block. The B block constituent or component is nonpolar thereby enabling hydrocarbon solubility. The AB diblock copolymers can be obtained from group transfer polymerization, and a subsequent polymer modification reaction of the group transfer prepared AB diblock copolymer in which the oxygen containing ammonium site is introduced into the polar A block via quaternization of the amine group in the base polymer precursor.

Embodiments of the present invention relate to a liquid electrostatographic developer comprised of (A) a nonpolar liquid having a Kauri-butanol value of from about 5 to about 30, and present in a major amount of from about 50 percent to about 95 weight percent, (B) thermoplastic resin particles with, for example, an average volume particle diameter of from about 0.5 to about 30 microns and preferably 1.0 to about 10 microns in average volume diameter; and pigment; (C) a nonpolar liquid soluble oxygen containing substituent covalently bound to the quaternary ammonium nitrogen in the quaternary ammonium AB diblock copolymer charge director; and (D) optionally a charge adjuvant compound.

Examples of suitable nonpolar liquid soluble charge directors selected for the developers of the present invention in various effective amounts, such as from about 0.1 to about 20 weight percent of developer solids, where solids are comprised of thermoplastic resin (40 to 99.9 percent), pigment (5 to 60 percent), and charge adjuvant (0.1 to 10 percent), include oxygen containing quaternary ammonium AB diblock copolymers wherein the A block is a polar block containing an oxygen containing substituent on at least 1 percent of the positive charge bearing ammonium sites and the B block is a nonpolar block. The polar and nonpolar blocks in the oxygen containing quaternary ammonium AB diblock copolymers are comprised of at least two consecutive polar repeat units or nonpolar repeat units, respectively. When the trivalent nitrogen in the polar A block of the base polymer charge director precursor is prepared by tetravalent via quaternization with an oxygen containing alkylating agent, an oxygen containing quaternary ammonium species is formed as the positive charge bearing site in the polar A block of the AB diblock copolymer charge director. Polar A blocks containing at least one oxygen containing substituent covalently bound to the quaternary ammonium nitrogen charge bearing site in the quaternary ammonium AB diblock copolymer charge directors of this invention have in embodiments provided superior charging properties when present in liquid developers at the same charge director concentration versus the corresponding AB diblock copolymer charge directors containing only alkyl substituents covalently bound to the quaternary ammonium nitrogen charge bearing site in the polar A block.

Moreover, embodiments of the present invention include liquid developers wherein the resin particles are comprised of a styrene polymer, an acrylate polymer, a methacrylate polymer, a polyester, or mixtures thereof; the resin particles are comprised of a copolymer of ethylene, and acrylic or methacrylic acid, an alkyl ester of acrylic or methacrylic acid wherein alkyl contains from 1 to about 5 carbon atoms or a copolymer of ethylene, and methacrylic acid with a melt index at 190° C. of 500; the charge director is present in an amount of from about 5 to 500 milligrams per gram of solid of thermoplastic resin particles, pigment, and charge adjuvant, and there is enabled a negatively charged toner; the nonpolar liquid is present in an amount of from 85 percent to 99.9 percent by weight, based on the total weight of the developer solids of resin, pigment, and charge adjuvant, which adjuvant can be present in an amount of from about 0.1 percent to about 15 percent by weight; and the block copolymer charge director is present in an amount of from about 0.25 to about 1,500 milligrams/gram of the developer solids comprised of resin, pigment, and charge adjuvant; the aliphatic hydrocarbon is a mixture of branched hydrocarbons with from about 12 to about 16 carbon atoms; the aliphatic hydrocarbon is a mixture of normal hydrocarbons with from about 12 to about 16 carbon atoms; the resin particles are comprised of an alkylene polymer, a styrene polymer, an acrylate polymer, a polyester, or mixtures thereof; the liquid developer is comprised of a nonpolar liquid, resin, pigment, charge adjuvant, and as a charge director an oxygenated AB diblock copolymer wherein A possesses a number average molecular weight of from about 20 to about 10,000, and the B block possesses a number average molecular weight of from about 2,000 to about 50,000.

In embodiments, the oxygen containing quaternary ammonium AB diblock copolymer charge directors are preferably comprised of A and B blocks.

The A block precursor can be a polyamine that is usually prepared from an amine containing monomer which after polymerization is alkylated by treatment with the appropriate oxygen containing alkylating agent to form the ammonium A block. Examples of specific monomers selected for polymerization to A blocks include N,N-dimethylamino-N-2-ethyl methacrylate, N,N-diethylamino-N-2-ethyl methacrylate, N,N-dimethylamino-N-2-ethyl acrylate, N,N-diethylamino-N-2-ethyl acrylate, N,N-morpholino-N-2-ethyl methacrylate, N,N-morpholino-N-2-ethyl acrylate, 4-vinylpyridine, 2-vinyl-pyridine, 3-vinyl pyridine, and the like.

Examples of specific monomers selected in preparing B blocks in the range amount of 0.1 to 100 percent include 2-ethylhexyl methacrylate, 2-ethoxyethyl methacrylate, 2-ethylhexyl acrylate, 2-ethoxyethyl acrylate, lauryl methacrylate, lauryl acrylate, cetyl acrylate, cetyl methacrylate, stearyl methacrylate, stearyl acrylate, butadiene, isoprene, methoxybutadiene, isobutylene, cyclohexylethylene, cyclohexenylethylene, mycrene, piperylene, 1-dodecene, 4-tert butylstyrene, 3-tert butylstyrene, cyclooctene, cyclopentene, norbornene, and the like.

One preferred oxygen containing quaternary ammonium AB diblock or ABA triblock copolymer charge director of the present invention contains (1) a polar A block which contains the oxygen containing positive quaternary ammonium group, and (2) nonpolar B block which has sufficient aliphatic content to enable the block copolymer to more effectively dissolve in the nonpolar liquid having a Kauri-butanol value of less than about 30, and in embodiments from about 5 to about 30. The A block has a number average molecular weight range of from about 200 to about 10,000, and the B block has a number average molecular weight range of from about 2,000 to about 50,000.

Oxygen containing alkylating agents in the range amount of 0.1 to 100 percent that may be selected to convert the amine containing A block precursor to the ammonium A block include 2-bromoethanol, 2-chloroethanol, 2-iodoethanol, 4-bromo-1-butanol, 10-bromo-1-decanol, 3-bromo-2,2-dimethyl-1-propanol, 3-bromo-2-methyl-1-propanol, 4-iodo-1-butanol, 6-bromo-1-hexanol, 12-bromo-1-dodecanol, cis and trans 4-iodo-1-1-cyclohexanol, 4-bromomethyl-phenethyl alcohol, cis and trans 1-(4-bromomethyl)-4-(2-hydroxyethyl) cyclohexane, 5-bromo-3-penten-1-ol, 3-bromo-1,2-propanediol, 2-bromo-2-nitro-1,3-propanediot, cis and trans 4-bromocyclohexane-1,2-diol, 2-bromoethyl ethyl ether, 2-ethoxyethyl-p-toluenesulfonate, 2-ethoxyethyl-methanesulfonate, 2-ethoxyethyltrifluoromethanesulfonate, 2-bromoethyl methyl ether, 4-methoxybenzyl bromide, 2-(N-mopholino) ethyl bromide, 1-bromo-2-(2-methoxyethoxy) ethane, epichlorohiydrin, 2-(2-chloroethoxy) ethanol, 2-[2-(2-cloroethoxy)ethoxy] ethanol, 4-bromo-1-butyric acid, 6-bromo-1-hexanoic acid, 3-iodo-1-propionic acid, 12-bromo-1-dodecanoic acid, 11-bromo-1-undecanoic acid, 4-(bromomethyl) phenylacetic acid, methyl bromoacetate, t-butyl bromoacetate, ethyl iodoacetate, alpha-bromo-gamma-butyrolactone, alpha-bromo-gamma-valerolactone, pivalolactone, and the like.

In another embodiment, the oxygen containing ammonium AB diblock copolymer can be prepared by the polymerization of oxygen containing ammonium A block monomers with the nonpolar B block monomers. Also, the oxygen containing ammonium AB diblock copolymer charge directors of this invention can be prepared by block copolymerization of an amine containing monomer and a nonpolar monomer followed by quaternization of the amine containing monomer with the oxygen containing alkylating agent, and then anion exchange of the synthetically produced anion with any desirable anion using a suitable phase transfer catalyst; or the oxygen containing block copolymer charge director is an A-B-A triblock copolymer with the polar A block and the nonpolar B block.

Examples of nonpolar liquid soluble oxygen containing ammonium AB diblock copolymers selected in the amount range of 0.1 to 100, and preferably from about 1 to 25 percent (nonpolar B block named first then polar A block) include poly[2-ethylhexyl methacrylate (B block)-co-N,N-dimethyl-N-(2-hydroxyethyl)-N-ethyl methacrylate ammonium bromide (A block)], poly[2-ethylhexyl methacrylate-co-N,N-dimethyl-N-(2-hydroxyethyl)-N-ethyl methacrylate ammonium tosylate], poly[2-ethylhexyl methacrylate-co-N,N-dimethyl-N-(2-hydroxyethyl)-N-ethyl methacrylate ammonium chloride], poly[2-ethylhexyl acrylate-co-N,N-dimethyl-N-(2-hydroxyethyl)-N-ethyl methacrylate ammonium bromide], poly[2-ethylhexyl acrylate-co-N,N-dimethyl-N-(2-hydroxyethyl)-N-ethyl acrylate ammonium bromide], poly[N,N-dibutyl methacrylamide-co-N,N-dimethyl-N-(2-hydroxyethyl)-N-ethyl methacrylate ammonium bromide], poly[N,N-dibutylacrylamide-co-N,N-dimethyl-N-(2-hydroxyethyl)-N-ethyl methacrylate ammonium bromide], poly[2-ethylhexyl methacrylate-co-N,N-dimethyl-N-(2-ethoxyethyl)-N-ethyl methacrylate ammonium bromide], poly[2-ethylhexyl methacrylate-co-N,N-dimethyl-N-(2-ethoxyethyl)-N-ethyl methacrylate ammonium trifluoromethanesulfonate], poly[2-ethylhexyl methacrylate-co-N, N-dimethyl-N-(2-ethoxyethyl)-N-ethyl methacrylate ammonium rosylate], poly[2-ethylhexyl methacrylate-co-N, N-dimethyl-N(2-ethoxyethyl)-N-ethyl methacrylate ammonium chloride], poly[2-ethylhexyl acrylate-co-N,N-dimethyl-N-(2-ethoxyethyl)-N-ethyl methacrylate ammonium bromide], poly[2-ethylhexyl acrylate-co-N,N-dimethyl-N-(2-ethoxyethyl)-N-ethyl methacrylate ammonium trifluoromethanesulfonate], poly[2-ethylhexyl acrylate-co-N,N-dimethyl-N-(2-ethoxyethyl)-N-ethyl acrylate ammonium bromide], poly[2-ethylhexyl acrylate-co-N,N-dimethyl-N-(2-ethoxyethyl)-N-ethyl acrylate ammonium trifluoromethanesulfonate], poly[N,N-dibutyl methacrylamide-co-N,N-dimethyl-N-(2-ethoxyethyl)-N-ethyl methacrylate ammonium bromide], poly[N,N-dibutyl methacrylamide-co-N,N-dimethyl-N-(2-ethoxyethyl)-N-ethyl methacrylate ammonium trifluoromethanesulfonate], poly[N,N-dibutylacrylamide-co-N,N-dimethyl-N-(2-ethoxyethyl)-N-ethyl methacrylate ammonium bromide], poly[N,N-dibutylacrylamide-co-N,N-dimethyl-N-(2-ethoxyethyl)-N-ethyl methacrylate ammonium trifluoromethanesulfonate], poly[2-ethylhexyl methacrylate-co-N,N-dimethyl-N-(2,3-dihydroxypropyl)-N-ethyl methacrylate ammonium bromide], poly[2-ethylhexyl methacrylate-co-N,N-dimethyl-N-(2,3-dihydroxypropyl)-N-ethyl methacrylate ammonium tosylate], poly[2-ethylhexyl methacrylate-co-N, N-dimethyl-N-(2,3-dihydroxypropyl)-N-ethyl methacrylate ammonium chloride], poly[2-ethylhexyl acrylate-co-N,N-dimethyl-N-(2,3-dihydroxypropyl)-N-ethyl methacrylate ammonium bromide], poly[2-ethylhexyl acrylate-co-N,N-dimethyl-N-(2,3-dihydroxypropyl)-N-ethyl acrylate ammonium bromide], poly[N,N-dibutyl methacrylamide-co-N,N-dimethyl-N-(2,3-dihydroxypropyl)-N-ethyl methacrylate ammonium bromide], poly[N,N-dibutylacrylamide-co-N,N-dimethyl-N-(2,3-dihydroxypropyl)-N-ethyl methacrylate ammonium bromide], poly[2-ethylhexyl methacrylate-co-N, N-dimethyl-N-(3-carboxypropyl)-N-ethyl methacrylate ammonium bromide], poly[2-ethylhexyl methacrylate-co-N, N-dimethyl-N-(3-carboxypropyl)-N-ethyl methacrylate ammonium tosylate], poly[2-ethylhexyl methacrylate-co-N, N-dimethyl-N-(3-carboxypropyl)-N-ethyl methacrylate ammonium chloride], poly[2-ethylhexyl acrylate-co-N,N-dimethyl-N-(3-carboxypropyl)-N-ethyl methacrylate ammonium bromide], poly[2-ethylhexyl acrylate-co-N,N-dimethyl-N-(3-carboxypropyl)-N-ethyl acrylate ammonium bromide], poly[N,N-dibutyl methacrylamide-co-N,N-dimethyl-N-(3-carboxypropyl)-N-ethyl methacrylate ammonium bromide], poly[N,N-dibutylacrylamide-co-N,N-dimethyl-N-(3-carboxypropyl)-N-ethyl methacrylate ammonium bromide], poly[2-ethylhexyl methacrylate-co-N, N-dimethyl-N-carbomethoxymethyl-N-ethyl methacrylate ammonium bromide], poly[2-ethylhexyl methacrylate-co-N, N-dimethyl-N-carbomethoxymethyl-N-ethyl methacrylate ammonium tosylate], poly[2-ethylhexyl methacrylate-co-N, N-dimethyl-N-carbomethoxymethyt-N-ethyl methacrylate ammonium chloride], poly[2-ethylhexyl acrytate-co-N,N-dimethyl-N-carbomethoxymethyl-N-ethyl methacrylate ammonium bromide], poly[2-ethylhexyl acrylate-co-N,N-dimethyl-N-carbomethoxymethyl-N-ethyl acrylate ammonium bromide], poly[N,N-dibutyl methacrylamide-co-N,N-dimethyl-N-carbomethoxymethyl-N-ethyl methacrylate ammonium bromide], poly[N,N-dibutylacrylamide-co-N,N-dimethyl-N-carbomethoxymethyl-N-ethyl methacrylate ammonium bromide], and the like.

Examples of nonpolar liquid soluble oxygen containing ammonium ABA triblock copolymers selected in the amount range of 0.1 to 100 percent, and preferably from 1 to about 35 percent (nonpolar B block named first then polar A block) include poly[N,N-dimethyl-N-(2-hydroxyethyl)-N-ethyl methacrylate ammonium bromide (A block)-co-2-ethylhexyl methacrylate (B block)-co-N,N-dimethyl-N-(2-hydroxyethyl)-N-ethyl methacrylate ammonium bromide (A block)], poly[N,N-dimethyl-N-(2-hydroxyethyl)-N-ethyl methacrylate ammonium tosylate-co-2-ethylhexyl methacrylate-co-N,N-dimethyl-N-(2-hydroxyethyl)-N-ethyl methacrylate ammonium tosylate], poly[N,N-dimethyl-N-(2-hydroxyethyl)-N-ethyl methacrylate ammonium chloride-co-2-ethylhexyl methacrylate-co-N,N-dimethyl-N-(2-hydroxyethyl)-N-ethyl methacrylate ammonium chloride], poly[N,N-dimethyl-N-(2-hydroxyethyl)-N-ethyl methacrylate ammonium bromide-co-2-ethylhexyl acrylate-co-N,N-dimethyl-N-(2-hydroxyethyl)-N-ethyl methacrylate ammonium bromide], poly[N,N-dimethyl-N-(2-hydroxyethyl)-N-ethyl acrylate ammonium bromide-co-2-ethylhexyl acrylate-co-N,N-dimethyl-N-(2-hydroxyethyl)-N-ethyl acrylate ammonium bromide], poly[N,N-dimethyl-N-(2-hydroxyethyl)-N-ethyl methacrylate ammonium bromide-co-N,N-dibutyl methacrylamide-co-N,N-dimethyl-N-(2-hydroxyethyl)-N-ethyl methacrylate ammonium bromide], poly[N,N-dimethyl-N-dimethyl-N-(2-hydroxyethyl)-N-ethyl methacrylate ammonium bromide-co-N,N-dibutylacrylamide-co-N,N-dimethyl-N-(2-hydroxyethyl)-N-ethyl methacrylate ammonium bromide], poly[N,N-dimethyl-N-(2-ethoxyethyl)-N-ethyl methacrylate ammonium bromide-co-2-ethylhexyl methacrylate-co-N,N-dimethyl-N-(2-ethoxyethyt)-N-ethyl methacrylate ammonium bromide], poly[N,N-dimethyl-N-(2-ethoxyethyl)-N-ethyl methacrylate ammonium trifluoromethanesulfonate-co-2-ethylhexyl methacrylate-co-N,N-dimethyl-N-( 2-ethoxyethyl)-N-ethyl methacrylate ammonium trifluoromethanesulfonate], poly [N,N-dimethyl-N-(2-ethoxyethyl)-N-ethyl methacrylate ammonium tosylate-co-2-ethylhexyl methacrylate-co-N,N-dimethyl-N-(2-ethoxyethyl)-N-ethyl methacrylate ammonium tosylate], poly[N,N-dimethyl-N-(2-ethoxyethyl)-N-ethyl methacrylate ammonium chloride-co-2-ethylhexyl methacrylate-co-N,N-dimethyl-N-(2-ethoxyethyl)-N-ethyl methacrylate ammonium chloride], poly[N,N-dimethyl-N-(2-ethoxyethy)-N-ethyl methacrylate ammonium bromide-co-2-ethylhexyl acrylate-co-N,N-dimethyl-N-(2-ethoxyethyl)-N-ethyl methacrylate ammonium bromide], poly[N,N-dimethyl-N-(2-ethoxyethyl)-N-ethyl methacrylate ammonium trifluoromethanesulfonate-co-2-ethylhexyl acrylate-co-N,N-dimethyl-N-(2-ethoxyethyl)-N-ethyl methacrylate ammonium trifluoromethanesulfonate], poly[N,N-dimethyl-N-(2-ethoxyethyl)-N-ethyl acrylate ammonium bromide-co-2-ethylhexyl acrylate-co-N,N-dimethyl-N-(2-ethoxyethyl)-N-ethyl acrylate ammonium bromide], poly[N,N-dimethyl-N-(2-ethoxyethyl)-N-ethyl acrylate ammonium trifluoromethanesulfonate-co-2-ethylhexyl acrylate-co-N,N-dimethyl-N-(2-ethoxyethyl)-N-ethyl acrylate ammonium trifluoromethanesulfonate], poly[N,N-dimethyl-N-(2-ethoxyethyl)-N-ethyl methacrylate ammonium bromide-co-N,N-dibutyl methacrylamide-co-N,N-dimethyl-N-(2-ethoxyethyl)-N-ethyl methacrylate ammonium bromide], poly[N,N-dimethyl-N-(2-ethoxyethyl)-N-ethyl methacrylate ammonium trifluoromethanesulfonate-co-N,N-dibutyl methacrylamide-co-N,N-dimethyl-N-(2-ethoxyethyl)-N-ethyl methacrylate ammonium trifluoromethanesulfonate], and the like.

Additional examples of nonpolar liquid soluble oxygen containing ammonium AB diblock copolymer and ABA triblock copolymer charge directors (polar A block named first then nonpolar B block) include poly[4-vinylpyridinium-N-2-hydroxyethyl (A block)-co-2-ethylhexyl methacrylate (B block) bromide], poly[4-vinylpyridine-N-2-ethoxyethyl-co-2-ethylhexyl methacrylate bromide], poly[4-vinylpyridinium-N-2,3-dihydroxypropyl-co-2-ethylhexyl methacrylate bromide], poly[4-vinylpyridinium-N-3-carboxypropyl-co-2-ethylhexyl methacrylate bromide], poly[4-vinylpyridinium-N-carbomethoxymethyl-co-2-ethylhexyl methacrylate bromide], poly[3-vinylpyridinium-N-2-hydroxyethyl-co-2-ethylhexyl methacrylate bromide], poly[3-vinylpyridinium-N-2-ethoxyethyl-co-2-ethylhexyl methacrylate bromide], poly[3-vinylpyridinium-N-2,3-dihydroxypropyl-co-2-ethylhexyl methacrylate bromide], poly[3-vinylpyridinium-N-3-carboxypropyl-co-2-ethylhexyl methacrylate bromide], poly[3-vinylpyridinium-N-carbomethoxymethyl-co-2-ethylhexyl methacrylate bromide], poly[4-vinylpyridinium-N-2-hydroxyethyl-co-2-ethylhexyl methacrylate tosylate], poly[4-vinylpyridinium-N-2-ethoxyethyl-co-2-ethylhexyl methacrylate trifluoromethanesulfonate], poly[4-vinylpyridinium-N-2,3-dihydroxypropyl-co-2-ethylhexyl methacrylate bromide], poly[3-vinylpyridinium-N-2,3-dihydroxypropyl-co-2-ethylhexyl methacrylate tosylate], poly[4-vinylpyridinium-N-3-carboxypropyl-co-2-ethylhexyl methacrylate bromide], poly [3-vinylpyridinium-N-3-carboxypropyl-co-2-ethylhexyl methacrylate trifluoromethanesulfonate], poly[4-vinylpyridinium-N-carbomethoxymethyl-co-2-ethylhexyl methacrylate bromide], poly[3-vinylpyridinium-N-carbomethoxymethyl-co-2-ethylhexyl methacrylate tosylate], and the like.

Examples of preferred oxygen containing ammonium AB diblock and ABA triblock copolymer charge directors of the present invention contain (1) a polar A block which contains the positive ammonium nitrogen to which is bonded at least one oxygen containing group; and (2) a nonpolar B block which has sufficient aliphatic content usually a minimum of four carbons with a maximum of about 100 carbons to enable the block copolymer to more effectively dissolve in the nonpolar liquid having a Kauri-butanol value of less than about 30, and in embodiments from about 5 to about 30. The A block has a number average molecular weight range of from about 200 to about 10,000, and the B block has a number average molecular weight range of from about 2,000 to about 50,000. Assuming an average $M_n$ of about 200 for both the A and B monomers, each A block molecular weight ranges powder for a DP of about 1 to about 50, and each B block molecularweight ranges provide for a DP of about 10 to about 250. Based on the above range of number average degree of polymerization (DP) for the polar A block, the mole percent of all the polar A block repeat units in the AB diblock copolymer charge directors of this invention can range from 0.4 to 83.3 percent. Based on the above range of number average degree of polymerization (DP) for the nonpolar B block, the mole percent of all the nonpolar B block repeat units in the AB diblock copolymer charge directors can range from 16.7 to 99.6 percent. The preferred repeat unit content of the polar A block is 60 to 5 mole percent and is more preferably at 40 to 10 mole percent, and the preferred repeat unit content of the nonpolar B block is 40 to 95 mole percent, and is more preferably at 60 to 90 mole percent. Amine nitrogen alkylation with oxygen containing alkylating agents to form the ammonium polar A block repeat unit can be at least 80 mole percent, and preferably at least 90 mole percent for excellent charge director performance.

The charge director can be selected for the liquid developers in various effective amounts, such as for example from about 0.5 percent to 100 percent by weight relative to developer solids, and preferably 2 percent to 20 percent by weight relative to developer solids. Developer solids includes toner resin, pigment, and optional charge adjuvant. Without pigment, the developer may be selected for the generation of a resist, or a printing plate.

Examples of liquid carriers or vehicles selected for the developers of the present invention include a liquid with viscosity of from about 0.5 to about 500 centipoise, and preferably from about 1 to about 20 centipoise, and a resistivity greater than or equal to $5\times10^9$ ohm/centimeter, such as $10^{13}$ ohm/centimeter or more. Preferably, the liquid selected in embodiments is a branched chain aliphatic hydrocarbon. A nonpolar liquid of the ISOPAR® series available from the Exxon Corporation may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is. between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of $10^9$ ohm-centimeters and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is from about 90 to about 99.9 percent,, and preferably from about 95 to about 99 percent by weight of the total developer dispersion. The total solids content of the developers is, for example, 0.1 to 10 percent by weight, preferably 0.3 to 3 percent, and more preferably 0.5 to 2.0 percent by weight.

Various suitable thermoplastic toner resins can be selected for the liquid developers of the present invention in effective amounts of, for example, in the range of 99 weight percent to 40 percent of developer solids, and preferably 95 percent to 70 percent of developer solids; developer solids includes the thermoplastic resin, optional pigment and charge control agent and any other component that comprises the particles. Examples of resins include ethylene vinyl acetate (EVA) copolymers (ELVAX® resins, E. I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is from 1 to about 20 carbon atoms like methyl methacrylate (50 to 90 percent)/methacrylic acid (0 to 20 percent/ethylhexyl acrylate (10 to 50 percent); and other acrylic resins including ELVACITE® acrylic resins (E. I. DuPont de Nemours and Company); or blends thereof. Preferred copolymers include copolymers of ethylene and an α-β-ethylenically unsaturated acid of either acrylic acid or methacrylic acid. In one preferred embodiment, NUCREL® like NUCREL® 599, NUCREL® 699, or NUCREL® 960 can be selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer. Examples of colorants include pigments like carbon blacks like REGAL 330®, cyan, magenta, yellow, blue, green, brown, and mixtures thereof; pigments as illustrated in U.S. Pat. No. 5,223,368, the disclosure of which is totally incorporated herein by reference, and more specifically, the following.

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |

-continued

| PIGMENT BRAND NAME | MANUFACTURER | COLOR |
|---|---|---|
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, Cl 77266 |
| UHLICH ® BK 8200 | Paul Uhlich | Black |

To increase the toner particle charge and, accordingly, increase the mobility and transfer latitude of the toner particles, charge adjuvants can be added to the toner. For example, adjuvants, such as metallic soaps, like aluminum or magnesium stearate or octoate, fine particle size oxides, such as oxides of silica, alumina, titania, and the like, paratoluene sulfonic acid, and polyphosphoric acid, may be added. Negative charge adjuvants increase the negative charge of the toner particle, while the positive charge adjuvants increase the positive charge of the toner particles. With the invention of the present application, the adjuvants or charge additives can be comprised of the metal catechol and aluminum hydroxy acid complexes illustrated in U.S. Pat. Nos. 5,306, 591 and 5,308,731, the disclosures of which are totally incorporated herein by reference, and which additives in combination with the charge directors of the present invention have, for example, the following advantages over the aforementioned prior art charge additives: improved toner charging characteristics, namely an increase in particle charge, as measured by ESA mobility, from −1.4 E-10 $m^2/Vs$ to −2.3 E-10 $m^2Vs$ that results in improved image development and transfer, from 80 percent to 93 percent, to allow improved solid area coverage, from a transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497, 208, the disclosure of which is totally incorporated herein by reference. This technique is particularly useful for nonaqueous dispersions because the measurements can be made at high volume loadings, for example greater than or equal to 1.5 to 10 weight percent. Measurements made by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid the thermoplastic resin, nonpolar liquid charging additive and colorant in a manner that the resulting mixture contains, for example, about 15 to about 30 percent by weight of solids; heating the mixture to a temperature from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding the charge adjuvant compound to the dispersion; and diluting the dispersion, followed by mixing with the charge director.

In the initial mixture, the resin, colorant and charge adjuvant may be added separately to an appropriate vessel such as, for example, an attrition, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. The charge director can generally be added at any point in the toner preparation but is preferably added after the particles have been reduced to their desired size. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. However, the temperature at which this step is undertaken should not be so high as to degrade the nonpolar liquid or decompose the resin or colorant when present. Accordingly, the mixture is heated to a temperature of from about 70° C. to about 130° C., and preferably to about 75° C. to about 110° C. The mixture may be ground in a heated ball mill or heated attrition at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids wherein solids include resin, charge adjuvant, and pigment concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a get or solid mass; followed by shredding the gel or solid mass and grinding by means of particulate media; or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of developers that can be selected are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference U.S. Pat. No. 5,306,591, the disclosure of which is totally incorporated herein by reference, the image is developed with the liquid toner illustrated herein by, for example, immersion of the photoconductor therein, followed by transfer and fixing of the image.

The invention will further be illustrated in the following nonlimiting Examples, it being understood that these Examples are intended to be illustrative only and that the invention is not intended to be limited to the materials, conditions, process parameters, and the like recited herein. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to give an ESA signal corresponding to a zeta potential of −26 millivolts for a 10 percent (v/v) suspension of LUDOX™ (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzer, manufactured by Horiba Instruments, Inc., Irvine, Calif.

Specific embodiments of the invention will now be described in detail. These Examples are intended to be illustrative, and the invention is not limited to the materials, conditions, or process parameters set forth in these embodiments. All parts and percentages are by weight unless otherwise indicated. Control Examples are also provided.

EXAMPLE I

LIQUID TONER PREPARATION 1

One hundred and seventy five (175.0) grams of NUCREL 599®, a copolymer of ethylene and methacrylic acid with a melt index at 190° C. of 500 dg/minute, available from E. I. DuPont de Nemours & Company, Wilmington, Del., 45.4 grams of the cyan pigment PV FAST BLUE™, 6.8 grams of aluminum stearate WITCO 22™, available from Witco Company, and 307.4 grams of NORPAR 15®, carbon chain of 15 average, available from Exxon Corporation, were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 86°to 96° C. for 2 hours and cooled by running water through the attritor jacket to 16° C. An additional 980.1 grams of NORPAR 15® were added, and ground in the attritor for an additional 4.5 hours. An additional 1,536 grams of NORPAR 15® were added and the mixture was separated by the use of a metal grate from the steel balls yielding a liquid toner concentrate of 7.13 percent solids wherein solids include resin, charge adjuvant, and pigment, and 92.87 percent NORPAR 15®. The particle diameter was 2.12 microns average by area as measured with a Horiba Cappa 500.

EXAMPLE II

BASE POLYMER PREPARATION 1

There was selected sequential Group Transfer Polymerization (GTP) of 2-ethylhexyl methacrylate (EHMA) and 2-dimethylaminoethyl methacrylate (DMAEMA) to prepare the AB diblock copolymer AB block polymer charge director precursor, poly[2-ethylhexyl methacrylate (B block)-co-N,N-dimethylamino-N-ethyl methacrylate (A block)], of quaternary ammonium block copolymer charge directors with oxygen containing ligands covalently bound to the quaternary ammonium nitrogen.

AB diblock copolymer precursors were prepared by a standard group transfer sequential polymerization procedure (GTP) wherein the 2-ethylhexyl ethacrylate monomer was first polymerized to completion and then the 2-dimethylaminoethyl methacrylate monomer was polymerized onto the living end of the ethythexyl methacrylate polymer. All glassware was first baked out in an air convection oven at about 120° C. for about 16 to 18 hours.

In a typical procedure, a 2 liter 3-neck round bottom flask equipped with a magnetic stirring football, an Argon inlet and outlet, and a neutral alumina (150 grams) column (later to be replaced by a rubber septum and then a liquid dropping funnel) was charged through the alumina column, which was maintained under a positive Argon flow and sealed from the atmosphere, with 415 grams (2.093 mole) of freshly distilled 2-ethylhexyl methacrylate (EHMA) monomer. Subsequently, 500 milliliters of freshly distilled tetrahydrofuran solvent, distilled from sodium benzophenone, was rinsed through the same alumina column into the polymerization vessel. Subsequently, the GTP initiator, 15 milliliters of methyl trimethylsilyl dimethylketene acetal (12.87 grams; 0.0738 mole), was syringed into the polymerization vessel. The acetal was originally vacuum distilled and a middle fraction was collected and stored (under Argon) for polymerization initiation purposes. After stirring for about 5 minutes at ambient temperature under a gentle Argon flow sufficient to maintain a positive pressure in the polymerization vessel observed as Argon bubbles exiting the vessel through a mineral oil bubble trap, 0.1 milliliter of a 0.66 molar solution of tetrabutylammonium acetate (catalyst) in the same dry tetrahydrofuran was syringed into the polymerization vessel. After an additional hour stirring under Argon, the polymerization temperature peaked at about 50° C. Shortly thereafter, 90 grams (0.572 mole) of freshly distilled 2-dimethylaminoethyl methacrylate (DMAEMA) monomer was dropwise added to the polymerization vessel. The polymerization solution was stirred under Argon for at least 4 hours after the temperature peaked. Then, 5 milliliters of methanol were added to quench the live ends of the fully grown copolymer. The above charges of initiator and monomers provided an $M_n$ and average degree of polymerization (DP) for each block. For the EHMA nonpolar B block, the charged $M_n$ was 5,621 and the DP was 28.3, and for the DMAEMA polar A block, the charged $M_n$ was 1,219 and the DP was 7.8. $^1$H-NMR analysis of a 20 percent (g/dl) $CDCl_3$ solution of the copolymer indicated a 76 to 78 mole percent EHMA content and a 22 to 24 mole percent DMAEMA content. GPC analysis was obtained on about a 100 milligram fraction of the 1 to 2 gram sample of isolated polymer using three 250 ×8 millimeters PHENOMENEX PHENOGEL™ columns in series (100, 500, 1,000 Angstroms) onto which was injected a 10 microliter sample of the block copolymer at 1 percent (weight/volume) in THF. The sample was eluted with THF at a flow rate of 1 milliliter/minute and the chromatogram was detected with a 254 nanometer UV detector. The GPC chromatogram was bimodal with the major peak occurring at 13.4 to 22.2 counts, and the minor low molecular weight peak at 23.5 to 28.3 counts. The major peak has a polystyrene equivalent number average molecular weight ($M_n$) of 2,346 and a weight average molecular weight ($M_w$) of 8,398 (MWD=3.58). This GPC analysis of the AB diblock copolymer suggests the presence of low molecular weight oligomeric impurities.

A small (1 to 2 grams) portion of the AB diblock copolymer can be isolated for GPC and $^1$H-NMR analyses by precipitation into 10 times its solution volume of methanol using vigorous mechanical agitation. The precipitated copolymer was then washed on the funnel with more methanol, and was then dried overnight (16 to 18 hours) in vacuo (about 0.5 Torr) at about 50° C.

The AB diblock copolymer prepared above was not isolated, but instead was solvent exchanged to provide a copolymer solution in toluene. Typically, the methanol quenched copolymer solution in tetrahydrofuran was rotoevaporated at about 50° C. at reduced pressure (40 to 50 millimeters Hg) in a tared round bottom flask until no more solvent distilled over. Then, toluene was added to provide about a 50 percent by weight solution of the block copolymer.

EXAMPLE III

BASE POLYMER PREPARATION 2

There was selected sequential Group Transfer Polymerization (GTP) of 2-ethylhexyl methacrylate (EHMA) and 2-dimethylaminoethyl methacrylate (DMAEMA) to prepare poly[2-ethylhexyl methacrylate (B block)-co-N,N-dimethylamino-N-ethyl methacrylate (A block)], of quaternary ammonium block copolymer charge directors with oxygen containing ligands covalently bound to the quaternary ammonium nitrogen.

A 2 liter 3-neck round bottom flask equipped with a magnetic stirring football, an Argon inlet and outlet, and a neutral alumina (150 grams) column (later to be replaced by a rubber septum and then a liquid dropping funnel) was charged through the alumina column, which was maintained under a positive Argon flow and sealed from the atmosphere, with 415 grams (2.093 mole) of freshly distilled 2-ethylhexyl methacrylate (EHMA) monomer. Subsequently, 500 milliliters of freshly distilled tetrahydrofuran solvent, distilled from sodium benzophenone, were rinsed through the same alumina column into the polymerization vessel. Subsequently, the GTP initiator, 26 milliliters of methyl trimethylsilyl dimethylketene acetat (22.31 grams; 0.1280 mole) was syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.1 milliliter of a 0.66 molar solution of tetrabutylammonium acetate (catalyst) in the same dry tetrahydrofuran, was syringed into the polymerization vessel. After an additional 1 hour of stirring under Argon, the polymerization temperature peaked at about 50° C. Shortly thereafter, 90 grams (0.572 mole) of freshly distilled 2-dimethylaminoethyl methacrylate (DMAEMA) monomer was dropwise added to the polymerization vessel. The polymerization solution was stirred under Argon for at least 4 hours after the temperature peaked. Then, 5 milliliters of methanol were added to quench the live ends of the fully grown copolymer. The above charges of initiator and monomers provide an $M_n$ and average degree of polymerization (DP) for each block. For the EHMA nonpolar B block, the charged $M_n$ was 3,243 and the DP was 16.4 and for the DMAEMA polar A block, the charged $M_n$ was 703 and the DP was 4.5. $^1$-NMR analysis of a 20 percent (g/dl) $CDCl_3$ solution of the copolymer indicated a 77 to 82 mole percent EHMA content and a 18 to 23 mole percent DMAEMA content. GPC analysis was obtained on 100 milligrams of the 1 to 2 gram sample of isolated polymer using three 250×8 millimeters of PHENOMENEX PHENOGEL™ columns in series (100, 500, 1,000 Angstroms) onto which was injected a 10 microliter sample of the block copolymer at 1 percent (weight/volume)in THF. The sample was eluted with THF at a flow rate of 1 milliliters/minute and the chromatogram was detected with a 254 nanometer UV detector. GPC analysis indicated the major peak at 14.5 to 19.9 counts to have a polystyrene equivalent number average molecular weight of 3,912 and a weight average molecular weight of 6,222 (MWD of 1.59). Two barely discernible broad low molecular weight peaks were located at 20 to 25.1 and 25.1 to 30 counts.

A small (1 to 2 grams) portion of the AB diblock copolymer can be isolated for GPC and $^1$-NMR analyses by precipitation into 10 times its solution volume of methanol using vigorous mechanical agitation. The precipitated copolymer was then washed on the funnel with more methanol, and was then dried overnight in vacuo (about 0.5 Torr) at about 0° C.

The bulk of the AB diblock copolymer prepared above was not isolated but instead was solvent exchanged to provide a copolymer solution in toluene. Typically, the methanol quenched copolymer solution in tetrahydrofuran was rotoevaporated at about 50° C. at reduced pressure (40 to 50 millimeters Hg) in a tared round bottom flask until no more solvent distilled over. Then, toluene was added to the solid polymeric residue to provide a solution of the block copolymer at various desired solid levels.

EXAMPLE IV

BASE POLYMER PREPARATION 3

An AB diblock copolymer, poly(2-ethylhexyl methacrylate-co-N,N-dimethylamino-N-ethyl methacrylate), was prepared as described in Example III using the same polymerization procedure and conditions except the polymerization scale was increased by a factor of three. $^1$-NMR danalysis of a 17.5 percent (grams/l) $CDCl_3$ solution of an isolated 1 to 2 gram portion of the AB diblock copolymer indicated about a 77 to 78 mole percent EHMA repeat unit content and a 22 to 23 mole percent DMAEMA repeat unit content. GPC analysis, as described in Polymer Preparation 2 of Example III, indicated the major peak at 14.4 to 22.6 counts to have a polystrene equivalent number average molecular weight of 2,253 and a weight average molecular weight of 5,978 (MWD of 2.65). A broad low molecular weight peak was located at 24 to 32 counts.

The bulk of the AB diblock copolymer prepared above was not isolated but instead was solvent exchanged to provide a copolymer solution in toluene. Typically, the methanol quenched copolymer solution in tetrahydrofuran was rotoevaporated at about 50° C. at reduced pressure (40 to 50 millimeters Hg) in a tared round bottom flask until no more solvent distilled over. Then, toluene was added to the solid polymeric residue to provide a solution of the block copolymer at any desired solids level, but usually at about 50 weight percent polymer solids. This AB diblock copolymer precursor, poly [2-ethylhexyl methacrylate (B block)-co-N, N-dimethylamino-N-ethyl methacrylate (A block)], was used to prepare a quaternary ammonium block copolymer charge director without oxygen containing groups covalently bonded to the quaternary ammonium nitrogen in Example V below.

EXAMPLE V

CHARGE DIRECTOR PREPARATION 1

Preparation of the methyl bromide quaternized ammonium charge director, poly(2-ethylhexyl methacrylate-co-N, N,N-trimethyl-N-ethyl methacrylate ammonium bromide), from poly(2-ethylhexyl methacrylate-co-N,N-dimethylamino-N-ethyl methacrylate) prepared in Example IV and methyl bromide.

To a 1 liter Erlenmeyer flask were added 150 grams of a 50.86 weight percent toluene solution of an AB diblock copolymer prepared in Example VI composed of 18.23 weight percent 2-dimethylaminoethyl methacrylate (DMAEMA) repeat units and 81.77 weight percent 2-ethylhexyl methacrylate (EHMA) repeat units. The 76.29 grams of AB diblock copolymer in the above toluene solution contains 13.91 grams (0.08846 mole) of DMAEMA repeat units. To this magnetically stirred solution at room temperature were added an additional 207 grams of toluene to provide a 21.4 percent copolymer solution and 46.2 milliliters (0.0924 mole) of a 2 molar solution of methyl bromide in t-butyl methyl ether. The charged mole percent ratio of methyl bromide to DMAEMA repeat units was 104.5 mole percent so that all of the DMAEMA repeat units have been targeted for conversion to the methyl bromide quaternized poly(2-ethylhexyl methacrylate-co-N,N-dimethylamino-N-ethyl methacrylate) charge director. After stirring for 21 hours at ambient conditions in a stoppered Erlenmeyer flask, the clear solution was rotoevaporated for 2 hours at 50° C. to 55° C. and 30 to 50 millimeters Hg to remove the excess methyl bromide and toluene. The solid residue was dried in vacuo at 50 to 55° C. for 2.5 to 3.0 hours at about 0.3 millimeter Hg to provide 89.62 grams (theory 84.69 grams) of solid methyl bromide quaternized charge director containing 4.93 grams (5.5 weight percent) of trapped toluene. $^1$-NMR analysis indicated no unquaternized DMAEMA repeat units based on the absence of a hydrogen signal for the gem dimethyl group on unquaternized nitrogen. The copolymer composition, based upon quantitative quaternization of the DMAEMA repeat units, was 26.34 weight percent (21.95 mole percent) methyl bromide quaternized DMAEMA repeat units and 73.66 weight percent (78.05 mole percent) EHMA repeat units.

A NORPAR 15® solution of charge director, poly(2-ethylhexyl methacrylate-co-N,N,N-trimethyl-N-ethyl methacrylate ammonium bromide), was prepared as follows. To 4.15 grams of the above methyl bromide quaternized ammonium solid charge director were added 370.3 grams of NORPAR 15® and the mixture was stirred at ambient conditions for 16 to 18 hours. The 4.15 grams of solid charge director was equivalent to 3.92 grams after adjusting for the 5.5 percent trapped toluene. The 3.92 grams were equivalent to 3.53 grams of prequaternized base polymer (prepared in Example IV), and the charge director concentration was about 0.94 weight percent based on the weight of prequaternized base polymer. This NORPAR 15® charge director solution was used to charge the liquid toner described in Control 1.

EXAMPLE VI

CHARGE DIRECTOR PREPARATION 2

Preparation of the 2-bromoethyl ethyl ether quaternized ammonium charge director, poly(2-ethylhexyl methacrylate-co-N,N-dimethyl-N-2-ethoxyethyl-N-ethyl methacrylate ammonium bromide), from poly(2-ethylhexyl methacrylate-co-N,N-dimethylamino-N-ethyl methacrylate) prepared in Example III and 2-bromoethyl ethyl ether.

To a 100 milliliter single neck round bottom flask were added 15.02 grams of a 21.37 weight percent toluene solution (3.21 grams of copolymer) from Base Polymer Preparation 2 in Example III. $^1$-NMR analysis indicated the prequaternized base polymer to be 79.64 mole percent (83.15 weight percent) EHMA and 20.36 mole percent (16.85 weight percent) DMAEMA. Based on this analysis, the 3.21 gram sample of copolymer contains 0.54 gram (0.00345 mole) DMAEMA repeat units. To this solution was added 0.59 gram (0.00345 mole) of the alkylating agent, 2-bromoethyl ethyl ether. The ether (Aldrich technical grade) was 90 weight percent 2-bromoethyl ethyl ether and 10 weight percent ethyl bromide. Since the ethyl bromide was quite volatile (bp 37 to 40° C.), it was assumed it would escape the water condenser, thus the 0.59 gram charge, targeting 100 mole percent of the tertiary amine DMAEMA groups, was based on the presence of 2-bromoethyl ethyl ether in the original Aldrich alkylation mixture. An additional 8.0 grams of toluene was added to rinse the ether into the reaction flask. The solution was heated at 50° C. for 16 to 18 hours and then at toluene reflux for 20 to 22 hours. After ambiently cooling the contents of the reaction vessel to less than 50° C., the flask was transferred to a rotoevaporator, and the contents were evaporated to dryness (water bath at 50° to 60° C. for 0.5 hour at 40 to 60 millimeters Hg). After drying the beige solid residue in vacuo at 50° to 60° C. for 16 to 18 hours, about 3.2 grams remained, which was 84.2 percent of theory. $^1$HNMR analysis indicated no unquaternized DMAEMA repeat units based on the absence of the hydrogen signal for the gem dimethyl group on unquaternized nitrogen. The copolymer composition, based upon quantitative quaternization of the DMAEMA repeat units, was 28.61 weight percent (20.36 mole percent) 2-bromoethyl ethyl ether quaternized DMAEMA repeat units and 71.39 weight percent (79.64 mole percent) EHMA repeat units.

A NORPAR 15® solution of charge director, poly(2-ethylhexyl methacrylate-co-N,N-dimethyl-N-2-ethoxyethyl-N-ethyl methacrylate ammonium bromide), was prepared as follows. To 2.00 grams of the above 2-bromoethyl ethyl ether quaternized ammonium solid charge director were added 170.3 grams of NORPAR 15® and the mixture was stirred at ambient conditions for 16 to 18 hours. The 2.00 grams of charge director was equivalent to 1.69 grams of prequaternized base polymer (prepared in Example III) and the charge director concentration was about 0.98 weight percent based on the weight of prequaternized base polymer. This NORPAR 15® charge director solution was used to charge the liquid toner described in Example XIA.

EXAMPLE VII

CHARGE DIRECTOR PREPARATION 3

Preparation of the 4-bromobutyric acid quaternized ammonium charge director, poly(2-ethylhexyl methacrylate-co-N,N-dimethyl-N-3-carboxypropyl-N-ethyl methacrylate ammonium bromide), from poly(2-ethylhexyl methacrylate-co-N,N-dimethylamino-N-ethyl methacrylate) prepared in Example II and 4-bromobutyric acid.

A 25 milliliter Erlenmeyer flask was charged with 8.16 grams of a 49 weight percent solution of Base Polymer 1 in toluene from Example II. The toluene solution contained 4.00 grams of base polymer 1 which contained about 0.78 gram (0.00496 mole) of 2-dimethylaminoethyl methacrylate (DMAEMA) repeat units. To this solution was added 0.77 gram (0.00461 mole) of 4-bromobutyric acid (98 percent from Aldrich). Thus, about 93 mole percent of all the DMAEMA repeat units were targeted for conversion to the 4-bromobutyric acid quaternized poly(2-ethylhexyl methacrylate-co-N,N-dimethylamino-N-ethyl methacrylate) charge director. The flask was stoppered and the resulting solution was magnetically stirred at 90° to 95° C. After 0.3 hour, a visual viscosity increase was noted indicating that the polymer modification reaction had already proceeded significantly. After 24 to 25 hours, the reaction solution was rotoevaporated to dryness at 70° to 80° C. at 40 to 60 millimeter Hg in about 0.5 hour. The solid residue was totally soluble in methanol at ambient temperature at about 15 to 20 weight percent, and since methanol was a nonsolvent for the starting poly(2-ethylhexyl methacrylate-co-N,N-dimethylamino-N-ethyl methacrylate) polymer, the change to methanol solubility indicated that the starting polymer has undergone substantial modification. The solid residue was dried in vacuo at 50° to 55° C. at 0.5 millimeter Hg for 16 to 18 hours to give 3.53 grams (74.0 percent of theory) of poly(2-ethylhexyl methacrylate-co-N,N-dimethyl-N-3-carboxypropyl-N-ethyl methacrylate ammonium bromide). The $^1$H-NMR spectrum of the residual solid was missing the proton signal (6H at 2.23 ppm) of the gem dimethyl group on the unquaternized nitrogen of the precursor polymer prepared in Example II indicating that quaternization by 4-bromobutyric acid was substantially complete. An infrared spectrum of the residual solid, as a film cast from $CHCl_3$ on a KBr disc, showed a strong broad absorption at 2,530 to 2,770 $cm^{-1}$ characteristic of the O-H stretch in the carboxylic acid group and a weak absorption at 1,562 $cm^{-1}$ characteristic of the asymmetric carbonyl stretching in the carboxylate anion group. The infrared spectrum indicated that the dominant reaction mode was ammonium quaternization instead of ammonium salt formation. The copolymer composition, based upon the charged 93 mole percent quaternization of the DMAEMA repeat units, was 31.45 weight percent (21.76 mole percent) 4-bromobutyric acid quaternized DMAEMA repeat units, 67.51 weight percent (76.60 mole percent) EHMA repeat units, and 1.04 weight percent (1.64 mole percent) unquaternized DMAEMA repeat units.

A NORPAR 15® solution of charge director, poly(2-ethylhexyl methacrylate-co-N,N-dimethyl-N-3-carboxypropyl-N-ethyl methacrylate ammonium bromide), was prepared as follows. To 2.38 grams of the above 3-bromobutyric acid quaternized solid charge director were added 5 to 10 milliliters of toluene to dissolve the polymer and then 198 grams of NORPAR 15®. The resulting solution was rotoevaporated at 50° to 60° C. for about 0.5 hour at 40 to 60 millimeters Hg to remove the toluene. The 2.38 grams of charge director were equivalent to 2.00 grams of prequaternized base polymer (prepared in Example II) and the charge director concentration was 1.00 weight percent based on the weight of prequaternized base polymer. This NORPAR 15® charge director solution was used to charge the liquid toner described in Example XIB.

EXAMPLE VIII

CHARGE DIRECTOR PREPARATION 4

Preparation of the 2-bromoethanol quaternized ammonium charge director, poly(2-ethylhexyl methacrylate-co-N,N-dimethyl-N-2-hydroxyethyl-N-ethyl methacrylate ammonium bromide), from poly(2-ethylhexyl methacrylate-co-N,N-dimethylamino-N-ethyl methacrylate) prepared in Example II and 2-bromoethanol.

A 100 milliliter single neck round bottom flask was charged with 8.17 grams of a 49 weight percent solution of the Base Polymer 1 in toluene of Example II. The toluene solution contained 4.00 grams of Base Polymer 1 which contained about 0.78 gram (0.00496 mole) of 2-dimethylaminoethyl methacrylate (DMAEMA) repeat units. To this solution was added 0.66 gram (0.00528 mole) of 2-bromoethanol (95 percent from Aldrich). Thus, the slight excess of 2-bromoethanol targeted all the DMAEMA repeat units for conversion to the 2-bromoethanol quaternized poly(2-ethylhexyl methacrylate-co-N,N-dimethylamino-N-ethyl methacrylate) charge director. The flask was equipped with a water condenser and the resulting toluene solution was refluxed for 21 hours, however, magnetic stirring was brief early in the reflux period since the contents of the flask became too viscous to stir. The reaction vessel and contents were next transferred to the rotoevaporator for evaporation of the toluene at 50° to 60° C. at 40 to 60 millimeters Hg in about 0.5 hour. The solid residue was next dried in vacuo at about 75° C. for 41 hours at about 0.5 millimeter Hg. The $^{1}$-NMR spectrum of the residual solid was missing the proton signal (6H at 2.23 ppm) of the gem dimethyl group on the unquaternized nitrogen of the precursor polymer prepared in Example II indicating that quaternization by 2-bromoethanol was substantially complete. The copolymer composition, based upon the charged 100 mole percent quaternization of the DMAEMA repeat units, was 30.30 weight percent (23.40 mole percent) 2-bromoethanol quaternized DMAEMA repeat units and 69.70 weight percent (76.60 mole percent) EHMA repeat units.

A NORPAR 15® solution of charge director, poly(2-ethylhexyl methacrylate-co-N,N-dimethyl-N-2-hydroxyethyl-N-ethyl methacrylate ammonium bromide), was predated as follows. To 2.32 grams of the above 2-bromoethanol quaternized solid charge director were added 5 to 10 milliliters toluene to dissolve the polymer and then 198 grams of NORPAR 15®. The resulting solution was rotoevaporated at 50° to 60° C. for about 0.5 hour at 40 to 0 millimeters Hg to remove the toluene. The 2.32 grams of charge director were equivalent to 2.00 grams of prequaternized base polymer (prepared in Example II) and the charge director concentration was 1.00 weight percent based on the weight of prequaternized base polymer. This NORPAR 15® charge director solution was used to charge the liquid toner described in Example XIC.

EXAMPLE IX

CHARGE DIRECTOR PREPARATION 5

Preparation of the 3-bromo-1,2-propanediol quaternized ammonium charge director, poly(2-ethylhexyl methacrylate-co-N,N-dimethyl-N-2,3-dihydroxypropyl-N-ethyl methacrylate ammonium bromide), from poly(2-ethylhexyl methacrylate-co-N,N-dimethylamino-N-ethyl methacrylate) prepared in Example II and 3-bromo-1,2-propanediol, A 100 milliliter single neck round bottom flask was charged with 6.03 grams of a 49.75 weight percent solution of Example II Base Polymer 1 in toluene. The toluene solution contained 3.00 grams of Base Polymer 1 which contained about 0.51 gram (0.00323 mole) of 2-dimethylaminoethyl methacrylate (DMAEMA) repeat units. The toluene solvent was rotoevaporated at about 60° C. for 0.5 to 1.0 hour at 40 to 60 millimeters Hg to leave the solid charge director residue to which was added about 8 grams of 1,1,2-trichloroethane and 0.50 gram (0.00323 mole) of 3-bromo-1,2-propanediol (98 percent from Aldrich). Thus, all the DMAEMA repeat units have been targeted for conversion to the 3-bromo-1,2-propanediol quaternized poly(2-ethylhexyl methacrylate-co-N,N-dimethylamino-N-ethyl methacrylate) charge director. The flask was equipped with a water condenser and the reaction mixture was brought to reflux. The resulting trichloroethane solution was magnetically stirred and refluxed (110° C.) for 17.5 hours and a solid phase separated from the original solution. About 5 grams of toluene cosolvent were added to the hot mixture, and shortly thereafter a solution resulted, which was further refluxed (110° C.) for 25.5 hours. The reaction vessel and contents were next transferred to the rotoevaporator for evaporation of the solvents at 50° to 60° C. at 40 to 60 millimeters Hg in about 0.5 hour. The solid residue was next briefly dried in vacuo at about 55° to 60° C. for 2 hours at about 0.5 millimeters Hg to give 3.21 grams of solid (91.7 percent of theory). The $^{1}$H-NMR spectrum of the residual solid was missing the proton signal (6H at 2.23 ppm) of the gem dimethyl group on the unquaternized nitrogen of the precursor polymer prepared in Example II indicating that quaternization by 3-bromo-1,2-propanediol was substantially complete. The copolymer composition, based upon the charged 100 mole percent quaternization of the DMAEMA repeat units, was 28.80 weight percent (20.44 mole percent) 3-bromo-1,2-propanediol quaternized DMAEMA repeat units and 71.20 weight percent (79.56 mole percent) EHMA repeat units.

A NORPAR 15® solution of charge director, poly(2-ethylhexyl methacrylate-co-N,N-dimethyl-N-2,3-dihydroxypropyl-N-ethyl methacrylate ammonium bromide), was prepared as follows. To 2.33 grams of the above 3-bromo-1,2-propanediol quaternized solid charge director were added 43.3 milliliters of toluene to dissolve the polymer and then 198 grams of NORPAR 15®. The resulting solution was rotoevaporated at 50° to 60° C. for at least 1.0 hour at 40 to 60 millimeters Hg to remove the toluene. The 2.33 grams of charge director were equivalent to 2.00 grams of prequaternized base polymer (prepared in Example II) and the charge director concentration was 1.00 weight percent based on the weight of prequaternized base polymer. This NORPAR 15® charge director solution was used to charge the liquid toner described in XID.

EXAMPLE X

CHARGE DIRECTOR PREPARATION 6

Preparation of the methyl bromoacetate quaternized ammonium charge director, poly(2-ethylhexyl methacrylate-co-N,N-dimethyl-N-carbomethoxymethyl-N-ethyl methacrylate ammonium bromide), from poly(2-ethylhexyl methacrylate-co-N,N-dimethylamino-N-ethyl methacrylate) prepared in Example II and methyl bromoacetate.

A 100 milliliter single neck round bottom flask was charged with 8.16 grams of a 49.00 weight percent solution of Example II Base Polymer 1 in toluene. The toluene solution contained 4.00 grams of Base Polymer 1 which contained about 0.78 gram (0.00496 mole) of 2-dimethytaminoethyl methacrylate (DMAEMA) repeat units. To this solution was added 0.68 gram (0.004465 mole) of methyl bromoacetate (97 percent from Aldrich). Thus, 90 mole percent of the DMAEMA repeat units have been targeted for conversion to the methyl bromoacetate quaternized poly(2-ethylhexyl methacrylate-co-N,N-dimethylamino-N-ethyl methacrylate) charge director. The flask was equipped with a water condenser and the resulting toluene solution was refluxed for 19 hours. Magnetic stirring became sluggish early in the reflux period since the contents of the flask became too viscous for vigorous magnetic stirring to continue. The reaction vessel and contents were next transferred to the rotoevaporator for evaporation of the toluene at 50° to 60° C. and 40 to 60 millimeters Hg for about 0.50 hour. The solid residue was next dried in vacuo for 6 hours at about 55° to 60° C. and then at about 75° C. for 17 hours at about 0.5 millimeter Hg during both heating stages. The $^1$H-NMR spectrum of the residual solid was missing the proton signal (6H at 2.23 ppm) of the gem dimethyl group on the unquaternized nitrogen of the precursor polymer prepared in Example II indicating that quaternization by methyl bromoacetate was substantially complete. The copolymer composition, based upon the charged 90 mole percent quaternization of the DMAEMA repeat units, was 29.50 weight percent (21.06 mole percent) methyl bromoacetate quaternized DMAEMA repeat units, 1.67 weight percent (2.34 mole percent) unquaternized DMAEMA repeat units, and 68.83 weight percent (76.60 mole percent) EHMA repeat units.

A NORPAR 15® solution of charge director, poly(2-ethylhexyl methacrylate-co-N,N-dimethyl-N-carbomethoxymethyl-N-ethyl methacrylate ammonium bromide), was prepared as follows. To 2.34 grams of the above methyl bromoacetate quaternized solid charge director were added 5 to 10 milliliters of toluene to dissolve the polymer and then 198 grams of NORPAR 15®. The resulting solution was rotoevaporated at 62° to 68° C. for about 0.67 hour at 40 to 60 millimeters Hg to remove the toluene. The 2.34 grams of charge director were equivalent to 2.00 grams of prequaternized base polymer (prepared in Example II) and the charge director concentration was 1.00 weight percent based on the weight of prequaternized base polymer. This NORPAR 15® charge director solution was used to charge the liquid toner described in Example XIE.

CONTROL 1

CYAN LIQUID DEVELOPER CHARGED WITH AB DIBLOCK NON-OXYGEN CONTAINING QUATERNIZED AMMONIUM BROMIDE CHARGE DIRECTOR

A cyan liquid toner dispersion was prepared by selecting 28.05 grams of liquid toner concentrate (7.13 percent solids with the ink solids being thermoplastic resin, pigment, and charge adjuvant in NORPAR 15®) from Example I and adding to it 161.95 grams of NORPAR 15®, and 10.0 grams of charge director poly(2-ethylhexylmethacrylate-co-N,N,N-trimethyl-N-ethyl methacrylate ammonium bromide) (0.94 percent solids in NORPAR 15®) from Example V. This resulted in a cyan liquid toner dispersion of 1 percent solids and 47 milligrams of charge director to 1 gram of toner solids or 4.7 percent charge director per gram of toner solids. The mobility and conductivity of the toner were measured after 2, 9, 24, and 39 days of charging and were compared to the corresponding values of the 1 percent toners of Example XI after similar time periods. The charging and conductivity results for the Control 1 cyan liquid developer and the comparative liquid developers prepared in Example XI are presented in Table 2 and the formulations for the developers are provided in Table 1. Both tables follow Example XI.

EXAMPLE X

CYAN LIQUID DEVELOPERS CHARGED WITH AB DIBLOCK OXYGEN CONTAINING QUATERNIZED AMMONIUM BROMIDE CHARGE DIRECTORS

Five cyan liquid toner dispersions (developers) at 1 percent solids in NORPAR 15® were prepared by mixing the components in Table 1 below wherein each oxygen containing charge director was used to charge the cyan toners at a charge director level of about 50 milligrams of charge director per gram of toner solid (50/1) or about 5 percent charge director per gram of toner solids.

After charge equilibrating for 1 or 2 days, a test was conducted to determine the charging level and the conductivity of the five (Examples XA thru XE ) 1 percent cyan liquid developers containing oxygen in at least one group attached to quaternized nitrogen (Table 1) versus the 1 percent cyan liquid developer containing only alkyl groups attached to quaternized nitrogen (non-oxygen containing Control 1) which was equilibrated for 2 days after charging. The results are presented in Table 2 below. Clearly the charging levels of the cyan liquid toners (developers) as measured by the indicated ESA mobilities in Examples XA thru XE in Table 2, wherein oxygen containing quaternized ammonium AB diblock charge directors were used to charge the liquid toner, exceed the mobility of the control cyan liquid toner dispersion (Control 1) charged with poly(2-ethylhexyl methacrylate-co-N,N,N-trimethyl-N-ethyl methacrylate ammonium bromide). This result indicated that the quaternized ammonium charge directors containing oxygen in at least one of the quaternizing substituents (Examples XA thru XE) charged cyan liquid toners more rapidly and to a higher charging level, when present at comparable charge director levels, than does the non-oxygen containing quaternized ammonium charge director in the Control 1 liquid toner.

TABLE 1

Formulation for Cyan Liquid Developers

| EXAMPLE | Grams Toner Concentrate from Example I | Grams Added NORPAR 15 ® | Grams Added Approx. 1% Charge Director | Charge Director Prepartion Example & Level in Milligrams CD/Gram Toner Solids |
|---|---|---|---|---|
| XA | 28.05 | 161.95 | 10.00 | Example VI at 49/1 |
| XB | 28.05 | 161.95 | 10.00 | Example VII at 50/1 |
| XC | 28.05 | 161.95 | 10.00 | Example VIII at 50/1 |
| XD | 28.05 | 161.95 | 10.00 | Example IX at 50/1 |
| XE | 28.05 | 161.95 | 10.00 | Example X at 50/1 |

TABLE 2

Cyan Liquid Developers

| EXAMPLE | Equilibration Time in Days | Charge Director Level in mg/g | Mobility $E^{-10}$ $m^2/Vs$ | Cond. pmho /cm | Comments: Charging Conductivity Oxygen Group in CD Copolymer |
|---|---|---|---|---|---|
| Control 1 | 2 | 47/1 | −0.38 | 1.0 | Low Charging & |
| | 9 | | −0.42 | 1.0 | Low Conductivity; |
| | 24 | | −0.30 | 1.0 | Alkyl Only, No |
| | 39 | | −0.27 | 1.0 | Oxygen Group |
| XA | 1 | 49/1 | −2.47 | 13 | High Charging & |
| | 4 | | −2.67 | 12 | Moderate |
| | 11 | | −2.32 | 11 | Conductivity; |
| | 30 | | −2.88 | 12 | Ether Group |
| XB | 1 | 50/1 | −2.01 | 11 | High Charging & |
| | 4 | | −1.93 | 11 | Moderate |
| | 11 | | −1.89 | 12 | Conductivity; |
| | 30 | | −2.14 | 13 | Carboxylic Acid Group |
| XC | 1 | 50/1 | −2.03 | 14 | High Charging & |
| | 4 | | −2.05 | 14 | Moderate |
| | 11 | | −1.92 | 14 | Conductivity; |
| | 30 | | −2.29 | 15 | Alcohol Group |
| XD | 1 | 50/1 | −1.74 | 14 | High Charging & |
| | 4 | | −1.85 | 13 | Moderate |
| | 11 | | −1.77 | 13 | Conductivity; Diol |
| | 30 | | −2.15 | 13 | Group |
| XE | 2 | 50/1 | −2.28 | 15 | High Charging & |
| | 9 | | −1.95 | 14 | Moderate |
| | 30 | | −2.03 | 15 | Conductivity; Ester Group |

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer consisting essentially of a nonpolar liquid, thermoplastic resin particles, a nonpolar liquid soluble charge director comprised of at least one oxygen containing group with from 1 to 5 oxygen atoms covalently bound to a quaternized ammonium nitrogen in an AB diblock copolymer wherein the A block is polar and is an ammonium containing polymer, and the B block is nonpolar and is a nonpolar fluid soluble polymer, and wherein the A blocks possess a number average molecular weight range of from about 200 to about 10,000 and the B blocks possess a number average molecular weight range of from about 2,000 to 50,000 and the ratio of weight average molecular weight $M_w$ to number average molecular weight $M_n$ is 1 to 5 for said AB diblock copolymer, and wherein said AB diblock copolymer charge director is selected from the group consisting of poly[2-ethylhexyl methacrylate-co-N,N-dimethyl-N-(2-hydroxyethyl)-N-ethyl methacrylate ammonium bromide], poly[2-ethylhexyl methacrylate-co-N,N-dimethyl-N-(2-ethoxyethyl)-N-ethyl methacrylate ammonium bromide], poly[2-ethylhexyl methacrylate-co-N,N-dimethyl-N-(2,3-dihydroxypropyl)-N-ethyl methacrylate ammonium bromide], poly[2-ethylhexyl methacrylate-co-N,N-dimethyl-N-(3-carboxypropyl)-N-ethyl methacrylate ammonium bromide], and poly[2-ethylhexyl methacrylate-co-N,N-dimethyl-N-carbomethoxymethyl-N-ethyl methacrylate ammonium bromide].

2. A negatively charged liquid developer comprised of a nonpolar liquid, thermoplastic resin particles, a charge adjuvant, pigment, and a nonpolar liquid soluble charge director block copolymer comprised of the oxygen containing AB diblock copolymer of claim 1.

3. A developer in accordance with claim 2 wherein the resin particles are comprised of a copolymer of ethylene and an α, β-ethylenically unsaturated acid selected from the group consisting of acrylic acid and methacrylic acid.

4. A developer in accordance with claim 2 wherein the resin particles are comprised of a styrene polymer, an acrylate polymer, a methacrylate polymer, a polyester, or mixtures thereof.

5. A developer in accordance with claim 2 wherein the charge director is present in an amount of from about 5 to 500 milligrams per gram of toner solids of thermoplastic resin particles, pigment, and charge adjuvant.

6. A developer in accordance with claim 2 wherein the liquid is an aliphatic hydrocarbon.

7. A developer in accordance with claim 6 wherein the aliphatic hydrocarbon is a mixture of branched hydrocarbons with from about 12 to about 16 carbon atoms.

8. A developer in accordance with claim 6 wherein the aliphatic hydrocarbon is a mixture of normal hydrocarbons with from about 12 to about 16 carbon atoms.

9. An imaging method which comprises forming an electrostatic latent image followed by the development thereof with the liquid developer of claim 2.

10. A developer according to claim 1 further containing a colorant.

11. A developer according to claim 10 wherein the colorant is a pigment or a dye.

12. A developer in accordance with claim 10 wherein the pigment is cyan, magenta, yellow, red, green, blue, or brown pigment, or mixtures thereof, or carbon black.

13. A negatively charged liquid electrostatographic developer comprised of a nonpolar liquid, thermoplastic resin particles, pigment, a charge adjuvant, and a nonpolar liquid soluble charge director comprised of an oxygen containing ABA triblock copolymer wherein the A block is polar and is an ammonium containing polymer, and the B block is nonpolar and is a nonpolar fluid soluble polymer, and wherein the A block possesses a number average molecular weight range of from about 200 to about 10,000, and the B block possesses a number average molecular weight range of from about 2,000 to 50,000 and the ratio of weight average molecular weight $M_w$ to number average molecular weight $M_n$ for said ABA triblock copolymer is from 1 to 5.

14. A developer in accordance with claim 13 wherein the resin particles are comprised of an alkylene polymer, a styrene polymer, an acrylate polymer, a polyester, or mixtures thereof.

15. A liquid developer consisting of a nonpolar liquid, thermoplastic resin particles, a nonpolar liquid soluble charge director comprised of at least one oxygen containing group with from 1 to 5 oxygen atoms covalently bound to a quaternized ammonium nitrogen in an AB diblock copolymer wherein the A block is polar and is an ammonium containing polymer, and the B block is nonpolar and is a nonpolar fluid soluble polymer, and wherein the A block possesses a number average molecular weight range of from about 200 to about 10,000 and the B block possesses a number average molecular weight range of from about 2,000 to 50,000 and the ratio of weight average molecular weight $M_w$ to number average molecular weight of said AB diblock copolymer is 1 to 5, and wherein said AB diblock copolymer charge director is selected from the group consisting of poly[2-ethylhexyl methacrylate (B block)-co-N,N-dimethyl-N-(2-hydroxyethyl)-N-ethyl methacrylate ammonium bromide (A block)], poly[2-ethylhexyl methacrylate-co-N,N-dimethyl-N-(2-ethoxyethyl)-N-ethyl methacrylate ammonium bromide], poly[2-ethylhexyl methacrylate-co-N,N-dimethyl-N-(2,3-dihydroxypropyl)-N-ethyl methacrylate ammonium bromide], poly[2-ethylhexyl methacrylate-co-N,N-dimethyl-N-(3-carboxypropyl)-N-ethyl methacrylate ammonium bromide], and poly[2-ethylhexyl methacrylate-co-N,N-dimethyl-N-carbomethoxymethyl-N-ethyl methacrylate ammonium bromide].

16. A liquid developer in accordance with claim 15 wherein the charge director is poly(2-ethylhexyl methacrylate-co-N,N-dimethyl-N-carbomethoxymethyl-N-ethyl methacrylate ammonium bromide).

17. A liquid developer consisting essentially of nonpolar liquid, thermoplastic resin particles, a nonpolar liquid soluble charge director comprised of at least one oxygen containing group with from 1 to 5 oxygen atoms covalently bound to a quaternized ammonium nitrogen in an AB diblock copolymer wherein the A block is polar and is an ammonium containing polymer, and the B block is nonpolar and is a nonpolar fluid soluble polymer, and wherein the A block possesses a number average molecular weight range of from about 200 to about 10,000 and the B block possesses a number average molecular weight range of from about 2,000 to 50,000 and the ratio of weight average molecular weight $M_w$ to number average molecular weight of said AB diblock copolymer is from 1 to 5, and wherein said AB diblock copolymer charge director is selected from the group consisting of poly[2-ethylhexyl methacrylate (B block)-co-N,N-dimethyl-N-(2-hydroxyethyl)-N-ethyl methacrylate ammonium bromide (A block)], poly[2-ethylhexyl methacrylate-co-N,N-dimethyl-N-(2-hydroxyethyl)-N-ethyl methacrylate ammonium tosylate], poly[2-ethylhexyl methacrylate-co-N,N-dimethyl-N-(2-hydroxyethyl)-N-ethyl methacrylate ammonium chloride], poly[2-ethylhexyl acrylate-co-N,N-dimethyl-N-(2-hydroxyethyl)-N-ethyl methacrylate ammonium bromide], poly[2-ethylhexyl acrylate-co-N,N-dimethyl-N-(2-hydroxyethyl)-N-ethyl acrylate ammonium bromide], poly[N,N-dibutyl methacrytamideoco-N,N-dimethyl-N-(2-hydroxyethyl)-N-ethyl methacrylate ammonium bromide], poly[N,N-dibutylacrylamide-co-N,N-dimethyl-N-(2-hydroxyethyl)-N-ethyl methacrylate ammonium bromide], poly[2-ethylhexyl methacrylate-co-N,N-dimethyl-N-(2-ethoxyethyl)-N-ethyl methacrylate ammonium bromide], poly[2-ethylhexyl methacrylate-co-N,N-dimethyl-N-(2-ethoxyethyl)-N-ethyl methacrylate ammonium trifluoromethanesulfonate], poly[2-ethylhexyl methacrylate-co-N,N-dimethyl-N-(2-ethoxyethyl)-N-ethyl methacrylate ammonium tosylate], poly[2-ethylhexyl methacrylate-co-N,N-dimethyl-N-(2-ethoxyethyl)-N-ethyl methacrylate ammonium chloride], poly[2-ethylhexyl acrylate-co-N,N-dimethyl-N-(2-ethoxyethyl)-N-ethyl methacrylate ammonium bromide], poly[2-ethylhexyl acrylate-co-N,N-dimethyl-N-(2-ethoxyethyl)-N-ethyl methacrylate ammonium trifluoromethanesulfonate], poly[2-ethylhexyl acrylate-co-N,N-dimethyl-N-(2-ethoxyethyl)-N-ethyl acrylate ammonium bromide], poly[2-ethylhexyl acrylate-co-N,N-dimethyl-N-(2-ethoxyethyl)-N-ethyl acrylate ammonium trifluoromethanesulfonate], poly[N,N-dibutyl methacrylamide-co-N,N-dimethyl-N-(2-ethoxyethyl)-N-ethyl methacrylate ammonium bromide], poly[N,N-dibutyl methacrylamide-co-N,N-dimethyl-N-(2-ethoxyethyl)-N-ethyl methacrylate ammonium trifluoromethanesulfonate], poly [N,N-dibutylacrylamide-co-N,N-dimethyl-N-(2-ethoxyethyl)-N-ethyl methacrylate ammonium bromide], poly[N,N-dibutylacrylamide-co-N,N-dimethyl-N-(2-ethoxyethyl)-N-ethyl methacrylate ammonium trifluoromethanesulfonate], poly[2-ethylhexyl methacrylate-co-N,N-dimethyl-N-(2,3-dihydroxypropyl)-N-ethyl methacrylate ammonium bromide], poly[2-ethylhexyl methacrylate-co-N,N-dimethyl-N-(2,3-dihydroxypropyl)-N-ethyl methacrylate ammonium tosylate], poly[2-ethylhexyl methacrylate-co-N,N-dimethyl-N-(2,3-dihydroxypropyl)-N-ethyl methacrylate ammonium chloride], poly[2-ethylhexyl acrylate-co-N,N-dimethyl-N-(2,3-dihydroxypropyl)-N-ethyl methacrylate ammonium bromide], poly[2-ethylhexyl acrylate-co-N,N-dimethyl-N-(2,3-dihydroxypropyl)-N-ethyl acrylate ammonium bromide], poly[N,N-dibutyl methacrylamide-co-N,N-dimethyl-N-(2,3-dihydroxypropyl)-N-ethyl methacrylate ammonium bromide], poly[N,N-dibutylacrylamide-co-N,N-dimethyl-N-(2,3-dihydroxypropyl)-N-ethyl methacrylate ammonium bromide], poly[2-ethylhexyl methacrylate-co-N,N-dimethyl-N-(3-carboxypropyl)-N-ethyl methacrylate ammonium bromide], poly[2-ethylhexyl methacrylate-co-N,N-dimethyl-N-(3-carboxypropyl)-N-ethyl methacrylate ammonium tosylate], poly[2-ethylhexyl methacrylate-co-N,N-dimethyl-N-(3-carboxypropyl)-N-ethyl methacrylate ammonium chloride], poly[2-ethylhexyl acrylate-co-N,N-dimethyl-N-(3-carboxypropyl)-N-ethyl methacrylate ammonium bromide], poly[2-ethylhexyl acrylate-co-N,N-dimethyl-N-(3-carboxypropyl)-N-ethyl acrylate ammonium bromide], poly[N,N-dibutyl methacrylamide-co-N,N-dimethyl-N-(3-carboxypropyl)-N-ethyl methacrylate ammonium bromide], poly[N,N-dibutylacrylamide-co-N,N-dimethyl-N-(3-carboxypropyl)-N-ethyl methacrylate ammonium bromide], poly[2-ethylhexyl methacrylate-co-N,N-dimethyl-N-carbomethoxymethyl-N-ethyl methacrylate ammonium bromide], poly[2-ethylhexyl methacrylate-co-N,N-dimethyl-N-carbomethoxymethyl-N-ethyl methacrylate ammonium tosylate], poly[2-ethylhexyl methacrylate-co-N,N-dimethyl-N-carbomethoxymethyl-N-ethyl methacrylate ammonium chloride], poly[2-ethylhexyl acrylate-co-N,N-dimethyl-N-carbomethoxymethyl-N-ethyl methacrylate ammonium bromide], poly[2-ethylhexyl acrylate-co-N,N-dimethyl-N-carbomethoxymethyl-N-ethyl acrylate ammonium bromide], poly[N,N-dibutyl methacrylamide-co-N,N-dimethyl-N-carbomethoxymethyl-N-ethyl methacrylate ammonium bromide], and poly[N,N-dibutylacrylamide-co- N,N-dimethyl-N-carbomethoxymethyl-N-ethyl methacrylate ammonium bromide].

18. A liquid electrostatographic developer comprised of (A) a nonpolar liquid having a Kauri-butanol value of from about 5 to about 30 and present in a major amount of from about 50 weight percent to about 95 weight percent based on the total weight of the liquid developer; (B) thermoplastic resin particles and pigment particles; (C) a block copolymer negative charge director comprised of at least one oxygen containing group covalently bonded to a quaternized ammonium nitrogen in an AB diblock copolymer or an ABA triblock copolymer, having a ratio of $M_w$ to $M_n$ of 1 to 5, wherein the A block is polar and is an ammonium containing polymer, and the B block is nonpolar and is a nonpolar fluid soluble polymer, and wherein the A block possesses a number average molecular weight range of from about 200 to about 10,000, and the B block possesses a number average molecular weight range of from about 2,000 to 50,000, wherein said AB diblock copolymer charge director is selected from the group consisting of poly[2-ethylhexyl methacrylate-co-N,N-dimethyl-N-(2-hydroxyethyl)-N-ethyl methacrylate ammonium bromide], poly[2-ethylhexyl methacrylate-co-N,N-dimethyl-N-(2-hydroxyethyl)-N-ethyl methacrylate ammonium tosylate], poly[2-ethylhexyl methacrylate-co-N,N-dimethyl-N-(2-hydroxyethyl)-N-ethyl methacrylate ammonium chloride], poly[2-ethylhexyl acrylate-co-N,N-dimethyl-N-(2-hydroxyethyl)-N-ethyl-methacrylate ammonium bromide], poly[2-ethylhexyl acrylate-co-N,N-dimethyl-N-(2-hydroxyethyl)-N-ethyl acrylate ammonium bromide], poly[N,N-dibutyl methacrylamide-co-N,N-dimethyl-N-(2-hydroxyethyl)-N-ethyl methacrylate ammonium bromide], poly[N,N-dibutylacrylamide-co-N,N-dimethyl-N-(2-hydroxyethyl)-N-ethyl methacrylate ammonium bromide], poly[2-ethylhexyl methacrylate-co-N,N-dimethyl-N-(2-ethoxyethyl)-N-ethyl methacrylate ammonium bromide], poly[2-ethylhexyl methacrylate-co-N, N-dimethyl-N-(2-ethoxyethyl)-N-ethyl methacrylate ammonium trifluoromethanesulfonate], poly[2-ethylhexyl methacrylate-co-N,N-dimethyl-N-(2-ethoxyethyl)-N-ethyl methacrylate ammonium tosylate], poly[2-ethylhexyl methacrylate-co-N,N-dimethyl-N-(2-ethoxyethyl)-N-ethyl methacrylate ammonium chloride ], poly [2-ethylhexyl acrylate-co-N, N-dimethyl-N- (2-ethoxyethyl)-N-ethyl methacrylate ammonium bromide], poly [2-ethylhexyl acrylate-co-N,N-dimethyl-N- (2-ethoxyethyl ) -N-ethyl methacrylate ammonium trifluoromethanesulfonate], poly[2-ethylhexyl acrylate-co-N,N-dimethyl-N-(2-ethoxyethyl)-N-ethyl acrylate ammonium bromide], poly[2-ethylhexyl acrylate-co-N,N-dimethyl-N-(2-ethoxyethyl)-N-ethyl acrylate ammonium trifluoromethanesulfonate], poly[N,N-dibutyl methacrylamide-co-N,N-dimethyl-N-(2-ethoxyethyl)-N-ethyl methacrylate ammonium bromide], poly[N,N-dibutyl methacrylamide-co-N,N-dimethyl-N-(2-ethoxyethyl)-N-ethyl methacrylate ammonium trifluoromethanesulfonate], poly [N,N-dibutylacrylamide-co-N,N-dimethyl-N-(2-ethoxyethyl)-N-ethyl methacrylate ammonium bromide], poly[N, N-dibutylacrylamide-co-N,N-dimethyl-N-(2-ethoxyethyl)-N-ethyl methacrylate ammonium trifluoromethanesulfonate], poly[2-ethylhexyl methacrylate-co-N,N-dimethyl-N-(2,3-dihydroxypropyl)-N-ethyl methacrylate ammonium bromide], poly[2-ethylhexyl methacrylate-co-N,N-dimethyl-N-(2,3-dihydroxypropyl)-N-ethyl methacrylate ammonium tosylate], poly[2-ethylhexyl methacrylate-co-N,N-dimethyl-N-(2,3-dihydroxypropyl)-N-ethyl methacrylate ammonium chloride], poly[2-ethylhexyl acrylate-co-N,N-dimethyl-N-(2,3-dihydroxypropyl)-N-ethyl methacrylate ammonium bromide], poly[2-ethylhexyl acrylate-co-N,N-dimethyl-N-(2,3-dihydroxypropyl)-N-ethyl acrylate ammonium bromide], poly[N,N-dibutyl methacrylamide-co-N,N-dimethyl-N-(2,3-dihydroxypropyl)-N-ethyl methacrylate ammonium bromide], poly[N,N-dibutylacrylamide-co-N,N-dimethyl-N-(2,3-dihydroxypropyl)-N-ethyl methacrylate ammonium bromide], poly[2-ethylhexyl methacrylate-co-N,N-dimethyl-N-(3-carboxypropyl)-N-ethyl methacrylate ammonium bromide], poly[2-ethylhexyl methacrylate-co-N,N-dimethyl-N-(3-carboxypropyl)-N-ethyl methacrylate ammonium tosylate], poly[2-ethylhexyl methacrylate-co-N, N-dimethyl-N-(3-carboxypropyl)-N-ethyl methacrylate ammonium chloride], poly[2-ethylhexyl acrylate-co-N,N-dimethyl-N-(3-carboxypropyl)-N-ethyl methacrylate ammonium bromide], poly[2-ethylhexyl acrylate-co-N,N-dimethyl-N-(3-carboxypropyl)-N-ethyl acrylate ammonium bromide], poly[N,N-dibutyl methacrylamide-co-N,N-dimethyl-N-(3-carboxypropyl)-N-ethyl methacrylate ammonium bromide], poly[N,N-dibutylacrylamide-co-N,N-dimethyl-N-(3-carboxypropyl)-N-ethyl methacrylate ammonium bromide], poly[2-ethylhexyl methacrylate-co-N, N-dimethyl-N-carbomethoxymethyl-N-ethyl methacrylate ammonium bromide], poly[2-ethylhexyl methacrylate-co-N, N-dimethyl-N-carbomethoxymethyl-N-ethyl methacrylate ammonium tosylate], poly[2-ethylhexyl methacrylate-co-N, N-dimethyl-N-carbomethoxymethyl-N-ethyl methacrylate ammonium chloride], poly[2-ethylhexyl acrylate-co-N,N-dimethyl-N-carbomethoxymethyl-N-ethyl methacrylate ammonium bromide], poly[2-ethylhexylacrylate-co-N,N-dimethyl-N-carbomethoxymethyl-N-ethyl acrylate ammonium bromide], poly[N,N-dibutyl methacrylamide-co-N,N-dimethyl-N-carbomethoxymethyl-N-ethyl methacrylate ammonium bromide], poly[N,N-dibutylacrylamide-co-N,N-dimethyl-N-carbomethoxymethyl-N-ethyl methacrylate ammonium bromide], poly[4-vinylpyridinium-N-2-hydroxyethyl-co-2-ethylhexyl methacrylate bromide], poly[4-vinylpyridinium-N-2-ethoxyethyl-co-2-ethylhexyl methacrylate bromide], poly[4-vinylpyridinium-N-2,3-dihydroxypropyl-co-2-ethylhexyl methacrylate bromide], poly[4-vinylpyridinium-N-3-carboxypropyl-co-2-ethylhexyl methacrylate bromide], poly [4-vinylpyridinium-N-carbomethoxymethyl-co-2-ethylhexyl methacrylate bromide], poly[3-vinylpyridinium-N-2-hydroxyethyl-co-2-ethylhexyl methacrylate bromide], poly[3-vinylpyridinium-N-2-ethoxyethyl-co-2-ethylhexyl methacrylate bromide], poly[3-vinylpyridinium-N-2,3-dihydroxypropyl-co-2-ethylhexyl methacrylate bromide], poly[3-vinylpyridinium-N-3-carboxypropyl-co-2-ethylhexyl methacrylate bromide], poly [3-vinylpyridinium-N-carbomethoxymethyl-co-2-ethylhexyl methacrylate bromide], poly[4-vinylpyridinium-N-2-hydroxyethyl-co-2-ethylhexyl methacrylate tosylate], poly[4-vinylpyridinium-N-2-ethoxyethyl-co-2-ethylhexyl methacrylate trifluoromethanesulfonate], poly[3-vinylpyridinium-N-2,3-dihydroxypropyl-co-2-ethylhexyl methacrylate tosylate], poly [3-vinylpyridinium-N-3-carboxypropyl-co-2-ethylhexyl methacrylate trifluoromethanesulfonate], and poly [3-vinylpyridinium-N-carbomethoxymethyl-co-2-ethylhexyl methacrylate tosylate], and said ABA triblock copolymer is selected from the group consisting of poly[N, N-dimethyl-N-(2-hydroxyethyl)-N-ethyl methacrylate ammonium bromide-co-2-ethylhexyl methacrylate-co-N,N-dimethyl-N-(2-hydroxyethyl)-N-ethyl methacrylate ammonium bromide], poly[N,N-dimethyl-N-(2-hydroxyethyl)-N-ethyl methacrylate ammonium tosylate-co-2-ethylhexyl methacrylate-co-N,N-dimethyl-N-(2-hydroxyethyl)-N-ethyl methacrylate ammonium tosylate], poly[N,N-dimethyl-N-(2-hydroxyethyl)-N-ethyl methacrylate ammonium chloride-co-2-ethylhexyl methacrylate-co-N,N-dimethyl-N-(2-hydroxyethyl)-N-ethyl methacrylate ammonium chloride], poly[N,N-dimethyl-N-(2-hydroxyethyl)-N-ethyl methacrylate ammonium bromide-co-2-ethylhexyl acrylate-co-N,N-dimethyl-N-(2-hydroxyethyl)-N-ethyl methacrylate ammonium bromide], poly[N,N-dimethyl-N-(2-hydroxyethyl)-N-ethyl acrylate ammonium bromide-co-2-ethylhexylacrylate-co-N,N-dimethyl-N-(2-hydroxyethyl)-N-ethyl acrylate ammonium bromide], poly[N,N-dimethyl-N-(2-hydroxyethyl)-N-ethyl methacrylate ammonium bromide-co-N,N-dibutyl methacrylamide-co-N,N-dimethyl-N-(2-hydroxyethyl)-N-ethyl methacrylate ammonium bromide], poly[N,N-dimethyl-N-(2-hydroxyethyl)-N-ethyl methacrylate ammonium bromide-co-N,N-dibutylacrylamide-co-N,N-dimethyl-N-(2-hydroxyethyl)-N-ethyl methacrylate ammonium bromide], poly[N,N-dimethyl-N-(2-ethoxyethyl)-N-ethyl methacrylate ammonium bromide-co- 2-ethylhexyl methacrylate-co-N,N-dimethyl-N-(2-ethoxyethyl)-N-ethyl methacrylate ammonium bromide], poly[N,N-dimethyl-N-(2-ethoxyethyl)-N-ethyl methacrylate ammonium trifluoromethanesulfonate-co-2-ethylhexyl methacrylate-co-N,N-dimethyl-N-(2-ethoxyethyl)-N-ethyl methacrylate ammonium trifluoromethanesulfonate], poly[N,N-dimethyl-N-(2-ethoxyethyl)-N-ethyl methacrylate ammonium tosylate-co-2-ethylhexyl methacrylate-co-N,N-dimethyl-N-(2-ethoxyethyl)-N-ethyl methacrylate ammonium tosylate], poly[N,N-dimethyl-N-(2-ethoxyethyl)-N-ethyl methacrylate ammonium chloride-co-2-ethylhexyl methacrylate-co-N,N-dimethyl-N-(2-ethoxyethyl)-N-ethyl methacrylate ammonium chloride], poly[N,N-dimethyl-N-(2-ethoxyethyl)-N-ethyl methacrylate ammonium bromide-co-2-ethylhexyl acrylate-co-N,N-dimethyl-N-(2-ethoxyethyl)-N-ethyl methacrylate ammonium bromide], poly[N,N-dimethyl-N-(2-ethoxyethyl)-N-ethyl methacrylate ammonium trifluoromethanesulfonate-co-2-ethylhexyl acrylate-co-N,N-dimethyl-N-(2-ethoxyethyl)-N-ethyl methacrylate ammonium trifluoromethanesulfonate], poly[N,N-dimethyl-N-(2-ethoxyethyl)-N-ethyl acrylate ammonium bromide-co-2-ethylhexyl acrylate-co-N,N-dimethyl-N-(2-ethoxyethyl)-N-ethyl acrylate ammonium bromide], poly[N,N-dimethyl-N-(2-ethoxyethyl)-N-ethyl acrylate ammonium trifluoromethanesulfonate-co-2-ethylhexyl acrylate-co-N,N-dimethyl-N-(2-ethoxyethyl)-N-ethyl acrylate ammonium trifluoromethanesulfonate], poly[N,N-dimethyl-N-(2-ethoxyethyl)-N-ethyl methacrylate ammonium bromide-co-N,N-dibutyl methacrylamide-co-N,N-dimethyl-N-(2-ethoxyethyl)-N-ethyl methacrylate ammonium bromide], and poly[N,N-dimethyl-N-(2-ethoxyethyl)-N-ethyl methacrylate ammonium trifluoromethanesulfonate-co-N,N-dibutyl methacrylamide-co-N,N-dimethyl-N-(2-ethoxyethyl)-N-ethyl methacrylate ammonium trifluoromethanesulfonate], and (D) a charge adjuvant.

19. A developer in accordance with claim 18 wherein the charge adjuvant is aluminum stearate.

20. An imaging method which comprises forming an electrostatic latent image followed by the development thereof with the liquid developer of claim 18.

* * * * *